US006048032A

United States Patent [19]

Stewart

[11] Patent Number: 6,048,032

[45] Date of Patent: Apr. 11, 2000

[54] LIGHTWEIGHT, WATERPROOF AND FOLDABLE SEAT WHICH CAN ALSO FUNCTION AS A SUPPORT

[76] Inventor: Harry Malcolm Stewart, 107 Wolftrap Rd. SE., Vienna, Va. 22180-4940

[21] Appl. No.: 09/118,020

[22] Filed: Jul. 17, 1998

[51] Int. Cl.[7] ..... A47C 7/00

[52] U.S. Cl. ..... 297/440.12; 248/174

[58] Field of Search ..... 297/440.12; 248/174

[56] References Cited

U.S. PATENT DOCUMENTS

| | | | |
|---|---|---|---|
| 3,250,570 | 5/1966 | Smith et al. | 297/440.12 |
| 3,608,916 | 9/1971 | Haiko | 297/440.12 |
| 3,695,703 | 10/1972 | Notko | 297/440.12 |
| 4,148,427 | 4/1979 | Baker | 248/174 X |
| 4,813,744 | 3/1989 | Scalisi et al. | 297/440.12 |
| 5,682,623 | 11/1997 | Fenoglio | 297/440.12 X |
| 5,860,704 | 1/1999 | Smith | 297/440.12 |

*Primary Examiner*—Peter M. Cuomo
*Assistant Examiner*—Stephen Vu

[57] ABSTRACT

A foldable seat or support structured from one or more blanks made of a lightweight and waterproof material which are tightly secured together at their ends and are cut and scored to provide fold lines and integral and foldable panels which can easily and quickly be folded into an assembled and operable seat or support capable of supporting heavy loads and capable of being used repeatedly even after being exposed to moisture. The seat is also structured to permit certain panels of the assembled and operable seat to be unfolded and thereafter refolded in a certain manner or sequence for a quick conversion into a tightly secured and self contained compact bundle or package for carrying, for use as a seat cushion, or for storage. A shoulder strap can be attached to the tightly secured bundle for ease of carrying or storage.

25 Claims, 7 Drawing Sheets

FIG. 1
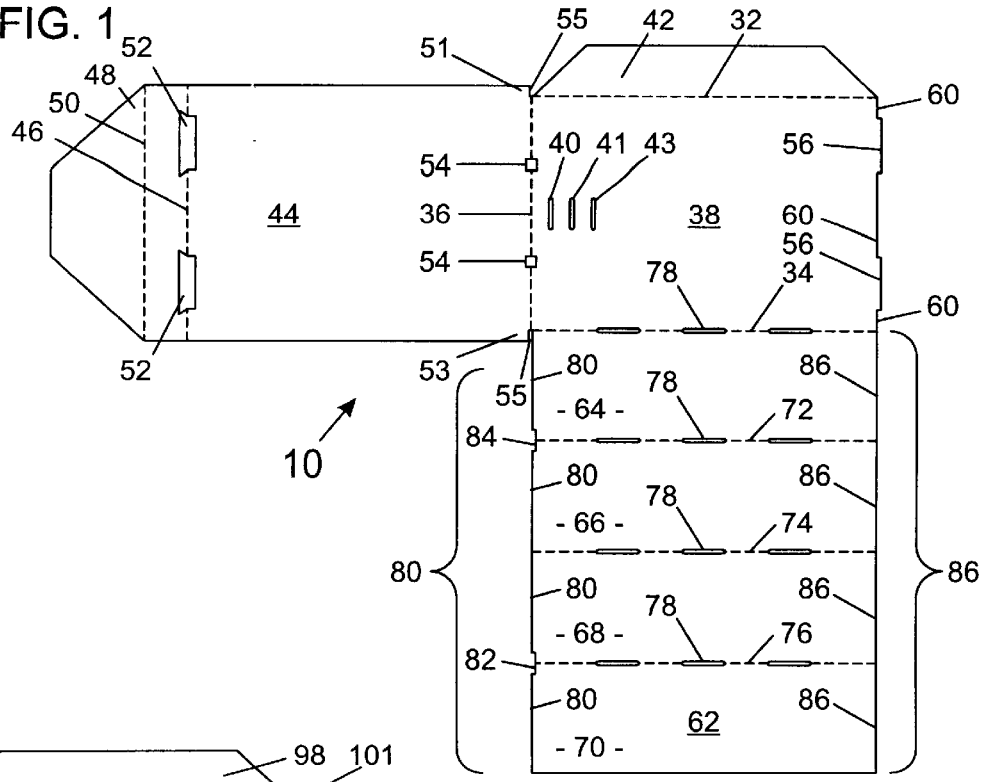
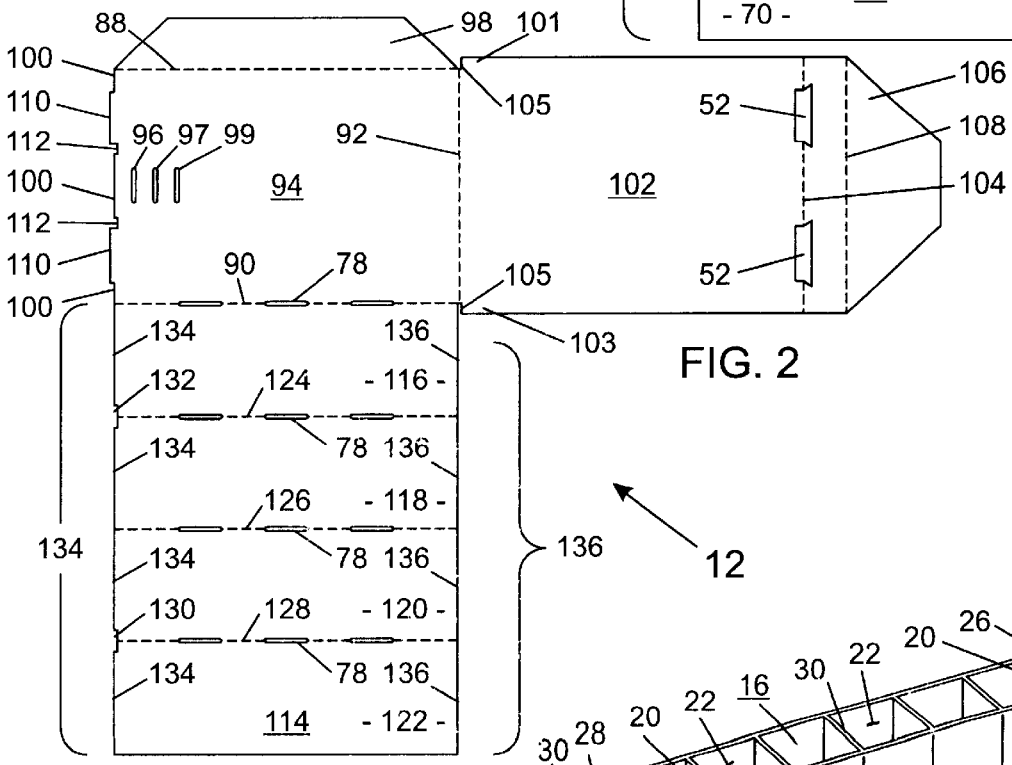
FIG. 2
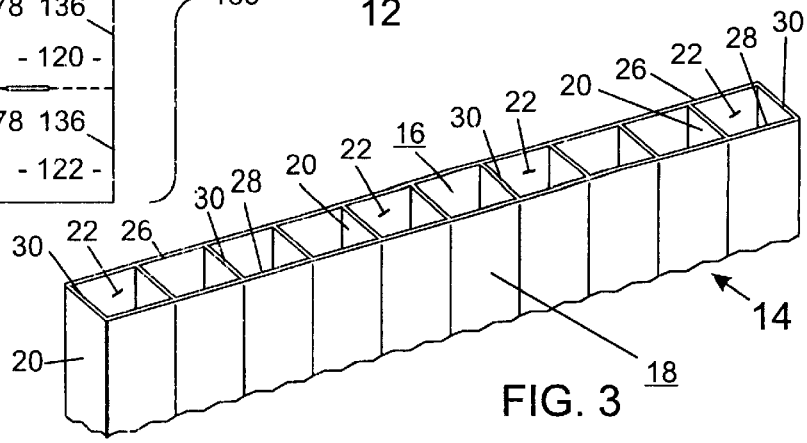
FIG. 3

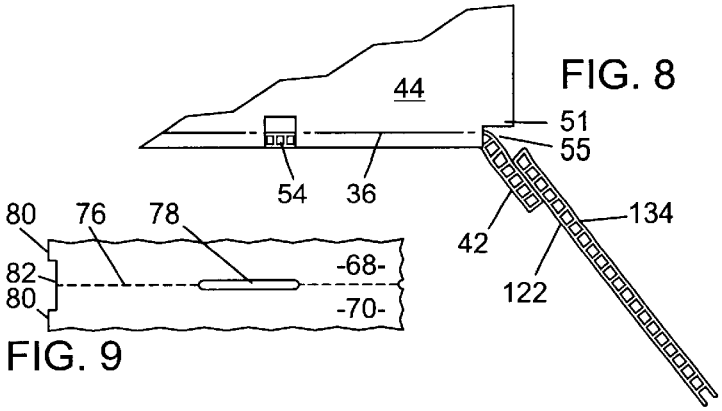
FIG. 8
FIG. 9
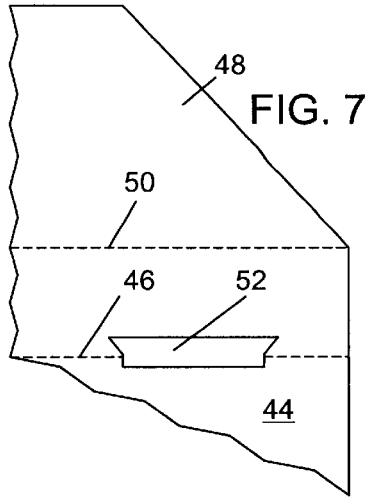
FIG. 7
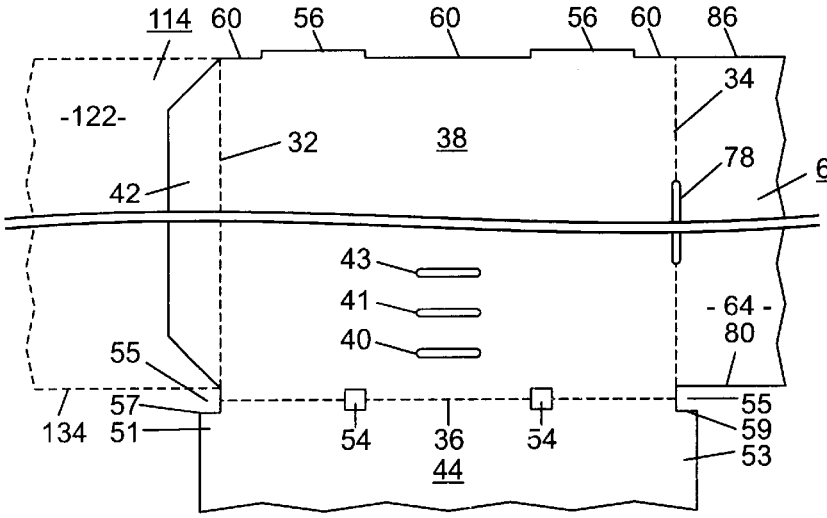
FIG. 10
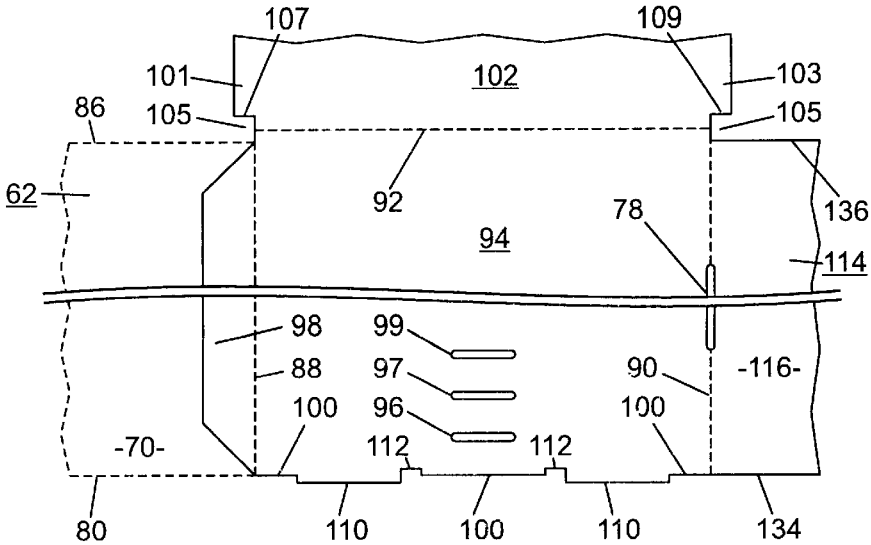
FIG. 11

FIG. 12
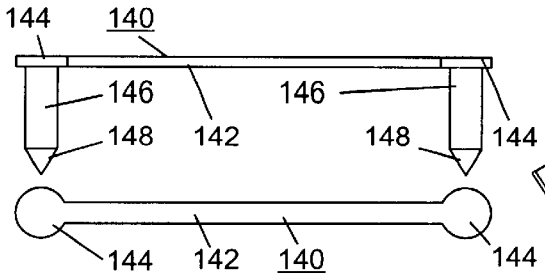
FIG. 13
FIG. 14
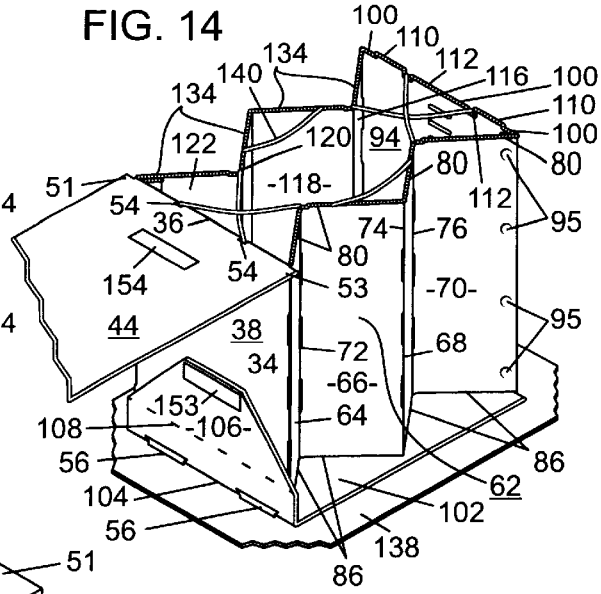
FIG. 15
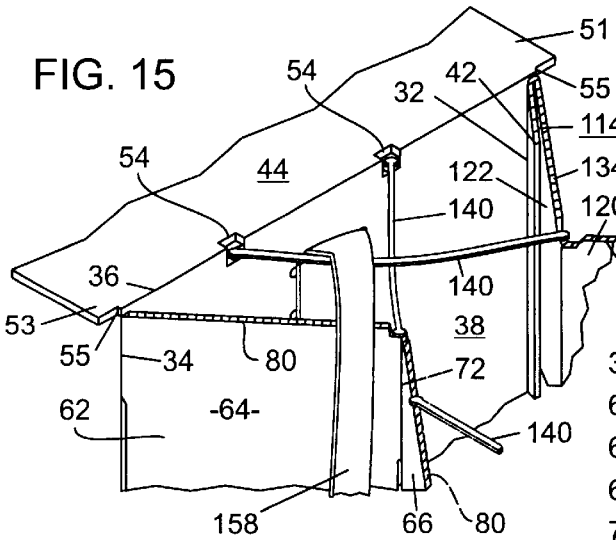
FIG. 16
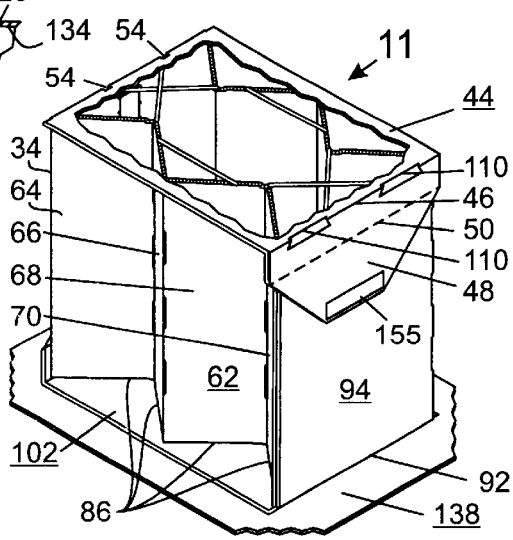
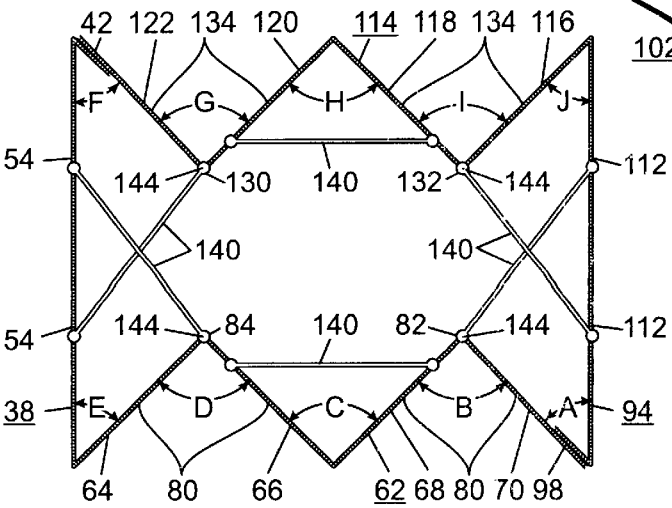
FIG. 17

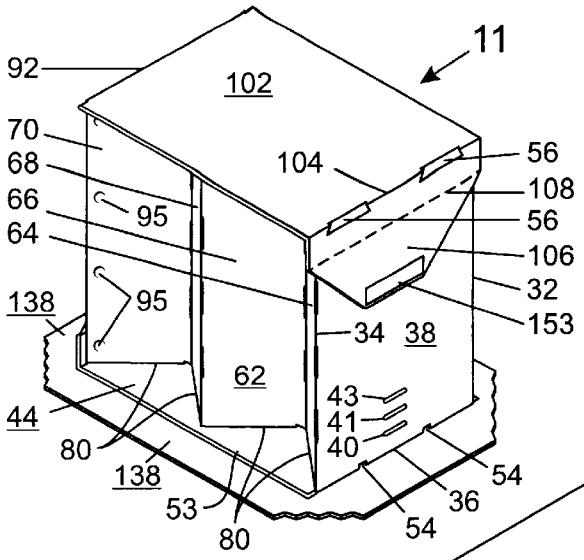
FIG. 18
FIG. 19
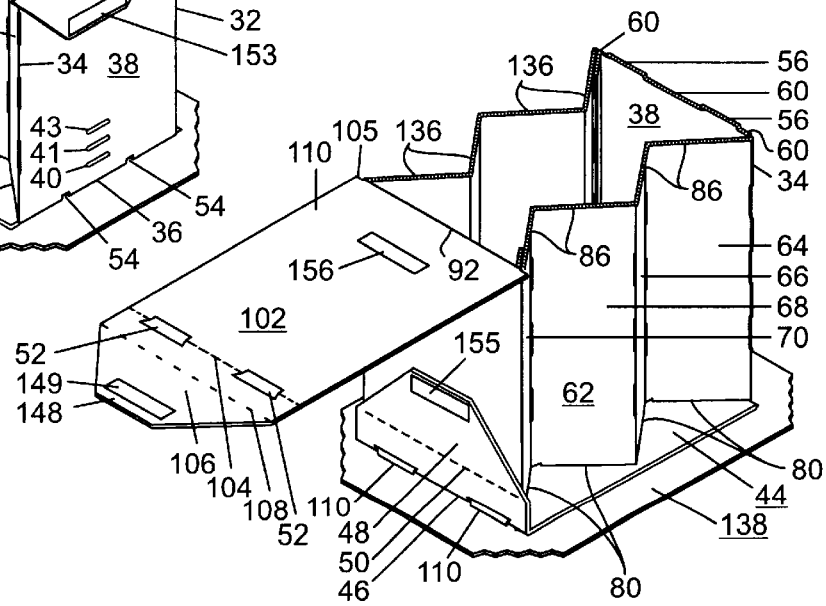
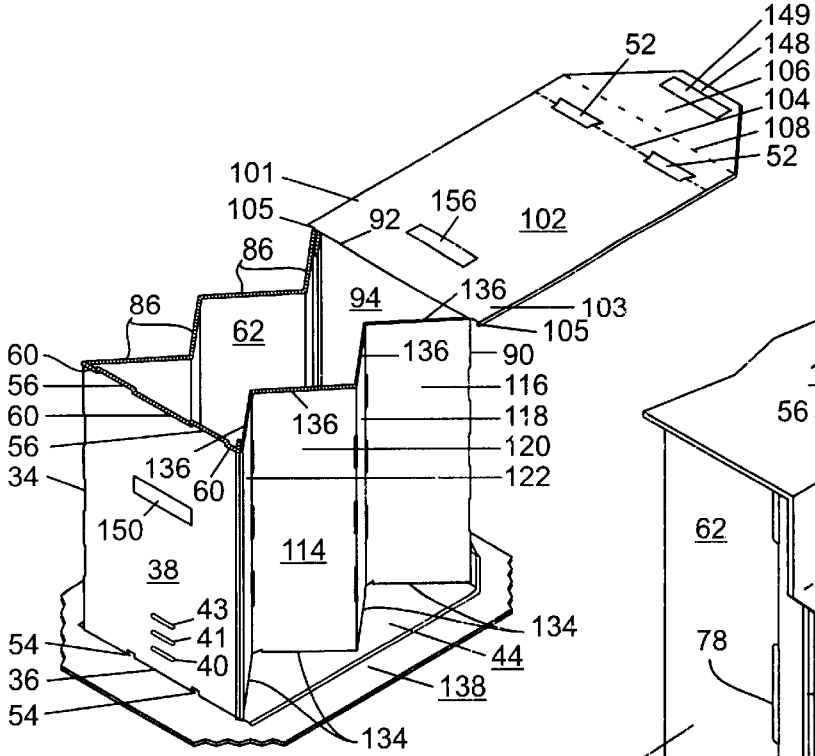
FIG. 20
FIG. 21
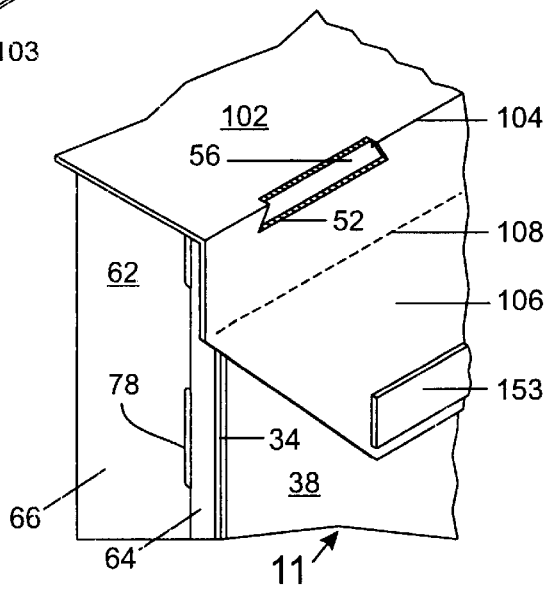

51
154
44
134
36
38
110
64
53
158
62
66
80
64
80
68
152
94
105
103
138
92
105
101
102
104
52
52
-106-
153
108
151
50
52
46
52
48
44
51
154
36
54
55
122
38
134
54
140
118
53
140
-120-
134
55
80
-64-
100
66
110
80
-68-
158
100
70
110
152
100
94
105
138
103
86
92
158
86
101
105
102
52
104
52
-106-
108
153
38
122
114
120
118
116
94

LIGHTWEIGHT, WATERPROOF AND FOLDABLE SEAT WHICH CAN ALSO FUNCTION AS A SUPPORT

FIELD OF INVENTION

This invention relates to a foldable seat which can also function as a support and, more particularly, to a foldable seat or support structured from one or more blanks made of a lightweight and waterproof material which are tightly secured together at their ends and are cut and scored to provide fold lines and integral and foldable panels which can easily and quickly be folded into an assembled and operable seat or support capable of supporting heavy loads and capable of being used repeatedly even after being exposed to moisture. The seat is also structured to permit certain panels of the assembled and operable seat to be unfolded and thereafter refolded in a certain manner or sequence for a quick conversion into a tightly secured and self contained compact bundle or package for carrying, for use as a seat cushion, or for storage. A shoulder strap can be attached to the tightly secured bundle for ease of carrying or storage.

BACKGROUND OF THE INVENTION

Foldable seats or supports have been patented and marketed for many years but have not been extensively used because of certain limitations inherent in the prior art structures. Many of such seats or supports were made of lightweight materials, usually corrugated cardboard, and such materials could only support light loads. If it was deemed necessary to support heavier loads, a greater amount of such material had to be incorporated into the seats or supports which made the seats or supports heavy and bulky. Many of such seats were difficult to fold and assemble and, once assembled into an operable seat, could not quickly and easily be unfolded and thereafter refolded in a certain manner or sequence to quickly convert the seat or support into a tightly secured and self contained compact bundle or package for carrying, for use as a seat cushion, or for storage.

Prior art seats or supports made of corrugated cardboard were particularly susceptible to water or moisture damage after which such seats or supports would lose their structural integrity and would have to be discarded as being not suitable for use. Seats or supports made of corrugated cardboard also had the disadvantage that they could only be folded and refolded along fold lines a small number of times before weakening the fold lines. Repeated folding would quickly damage the fold lines and such would quickly affect the structural integrity of the seat or support.

Seats made of heavier and stronger materials such as metal, fiberboard or plywood would support heavier loads and would not be affected as severely by moisture. Seats or supports made of such materials were, however, bulky and harder to carry or transport. Such seats or supports were also more costly to manufacture, and the panels of the seats were connected in many instances by mechanical hardware such as hinges rather than along fold lines.

The seat or support of the present invention eliminates the disadvantages of the prior art by utilizing corrugated plastic as the material used in the construction of the seat or support. The corrugated plastic is comprised of polypropylene copolymers extruded into corrugated plastic sheets which are cut into one or more blanks which in turn are tightly secured together at their ends and cut and scored to provide fold lines and integral and foldable panels that can quickly and easily be folded into an assembled and operable seat.

The integral and foldable panels can also be unfolded and thereafter refolded in a certain manner or sequence to quickly convert the seat into a tightly secured and self contained compact bundle or package for carrying, for use as a seat cushion, or for storage.

The corrugated plastic is waterproof and a seat or support constructed therefrom will not be structurally impaired when exposed to moisture. The corrugated plastic will support heavy loads and will not fail along the fold lines after repeated bending.

A seat or support incorporating the present invention is comprised of a combination of structural elements not disclosed, suggested or taught by the prior art and such structural elements as well as the functions thereof will be discussed in greater detail hereinafter. The seat or support of the instant invention, also as will be discussed in greater detail hereinafter, includes auxiliary components or hardware which hold the panels of the seat in tight engagement and also position or preposition certain panels of the seat or support to effectively carry and distribute a load applied to the seat or support.

PRIOR ART

The U.S. Patents listed below are considered by the applicant to constitute the most pertinent prior art relating to the present invention.

| | |
|---|---|
| Parrott | 2,049,659 |
| Sachs | 2,361,875 |
| Mather | 2,390,546 |
| Lang | 2,513,880 |
| Bowman | 2,550,959 |
| Paige et al | 2,659,483 |
| Madden | 2,680,557 |
| Hennessey | 2,920,852 |
| Lizan et al | 3,126,140 |
| Lyles | 3,168,347 |
| Smith et al | 3,250,570 |
| Suzuki | 3,312,503 |
| Harrison, Jr. | 3,331,634 |
| Giebel | 3,463,546 |
| Krone | 3,606,459 |
| Klein | 4,085,970 |
| Hildebrand | 4,546,941 |
| Calco | 4,648,658 |
| Volpe et al | 4,811,987 |
| Volpe et al | 4,877,292 |
| Scalisi et al | 4,984,848 |
| Henry | 5,382,081 |

SUMMARY OF THE INVENTION

The seat or support of the present invention is made of corrugated plastic which is cut into one or more blanks that are tightly secured together at their ends and are cut and scored to provide fold lines that define integral and foldable panels that can easily and quickly be folded into an assembled and operable seat or support.

The foldable panels include first and second upstanding end panels, a bottom panel foldably connected at one end to the bottom end of the first upstanding end panel along a fold line, and a top panel foldably connected at one end to the top of the second upstanding end panel along a fold line. The bottom and top panels at their opposite ends each have an integral flap connected thereto along a fold line.

A first and second plurality of upstanding load supporting panels, with the panels in each plurality being foldably connected to each other along fold lines, are secured at their ends to opposite sides of the upstanding end panels. The first plurality of said upstanding load supporting panels is foldably connected at one end to one side of said first upstanding end panel along a fold line and at the opposite end is rigidly secured to a flap foldably connected to the corresponding side of the second upstanding end panel along a fold line. The second plurality of upstanding load supporting panels is similarly foldably connected at one end along a fold line to one side of said second upstanding end panel (side opposite said flap thereon) and at the opposite end is rigidly secured to a flap foldably connected along a fold line to the corresponding side of said first upstanding end panel. The upstanding load supporting panels are firmly connected to the sides of both upstanding end panels and thus tie together or unite the upstanding end panels and the first and second plurality of upstanding load supporting panels.

The upstanding load supporting panels in each plurality are also connected to the upstanding end panels and two of the upstanding load supporting panels in each plurality are connected to each other by a plurality of connector means or connectors which constitute auxiliary components of the seat or support and which in this preferred embodiment of the invention take the form of elongated straps all of which are identical in size and construction and have a preselected length. The connectors or straps not only connect the load supporting panels to the upstanding end panels but also hold the foldable load supporting panels in each plurality in a partially folded triangular configuration with pairs of panels in each plurality intersecting each other and forming angles of intersection falling within a preselected range of degrees and with the end panels in each plurality of upstanding load supporting panels intersecting the two upstanding end panels and also forming angles of intersection falling within a preselected range of degrees.

With the panels in each triangular configuration in each plurality being so held and connected, the apexes of two of the triangles in each plurality of upstanding load supporting panels extend inwardly or transversely of said upstanding end panels and said top and bottom panels, and one apex of one of the triangles in each plurality of upstanding load supporting panels extends outwardly or transversely of said upstanding end panels and said top and bottom panels. When all of the panels and auxiliary components of the seat or support are folded and rigidly or tightly assembled into an assembled and operable seat or support, the first and second plurality of upstanding load support panels being so held and assembled in a partially folded triangular configuration will provide load support that is distributed substantially evenly and effectively over the surfaces of the top and bottom panels and the two upstanding end panels.

The connectors or straps are applied to and connect the first and second plurality of upstanding load supporting panels to the two upstanding end panels and are also applied to and connect two of the panels in each plurality of upstanding load supporting panels to each other prior to the time the upstanding end panels, the upstanding load supporting panels and the top and bottom panels together with the auxiliary components are moved or folded into an assembled and operable seat or support. Expressed in another manner, the auxiliary components or straps are applied to the upstanding end panels and the upstanding load supporting panels during the initial assembly of some of the panels of the seat or support into a workable combination of structural elements that can thereafter be folded into an assembled and operable seat or support. When the straps are applied to the affected panels during this initial or early stage of assembly, the straps are not drawn tight but on the contrary assume an arcuate configuration or have slack therein. The construction of the straps including the dimensions thereof, the configuration thereof and the material or materials employed combine to provide this slack as will be discussed in detail hereinafter. When all of the panels of the seat or support together with the straps and other auxiliary components are applied, folded and assembled into an operable seat or support, the straps will be stretched taut or will assume a straight line configuration and will thus hold the affected panels in tight assembly, as will be discussed in greater detail hereinafter.

When all of the panels and auxiliary components are moved or folded into an assembled and operable seat or support, the connectors or straps hold the upstanding load supporting panels and the upstanding end panels in tight assembly and, at the same time, position or preposition the upstanding load supporting panels between the two upstanding end panels and the top and bottom panels to effectively carry a load applied to the seat or support. The connectors or straps prevent the first and second plurality of load supporting panels from bulging outwardly or transversely of the upstanding end panels and the top and bottom panels and, similarly, prevent the load supporting panels from bulging inwardly or transversely of the upstanding end panels and the top and bottom panels. The connectors or straps, furthermore, eliminate wobble or relative movement of the upstanding load supporting panels and they, thus, assist in stabilizing the seat or support when all of the panels and auxiliary components of the seat or support are folded and held in an assembled and operable configuration and a load is applied to the seat or support.

The first upstanding end panel has a pair of tabs on the top end wall thereof and the second upstanding end panel has a pair of tabs on the bottom end wall thereof. The two tabs on each end wall are received in a pair of slots in the top and bottom panels and the flaps thereon when the top and bottom panels are folded into engagement with the top and bottom end walls of the two upstanding end panels, following which the flaps on the top and bottom panels are folded into engagement with and are tightly secured to the outside surfaces of said first and second upstanding end panels to hold the assembled panels of said seat or support in tight assembly.

The flaps on the top and bottom panels are secured to the outside surfaces of the first and second upstanding end panels by quick connect and disconnect fastening means or fasteners which are also auxiliary components in this preferred embodiment of the invention and take the form in this instance of hook and loop, strip, two-part fasteners, or more particularly, VELCRO® two-part fasteners. A loop of a two-part fastener is tightly secured to the inside surface of each flap near the free end thereof opposite the fold line and is adapted or positioned to mate and coact with a hook of the two-part fastener positioned and tightly secured to the outside surfaces of the first and second upstanding end panels.

When the top and bottom panels are folded into engagement with the top and bottom end walls of the first and second upstanding end panels and with the tabs on the end panels being received in pairs of slots in the top and bottom panels and the flaps thereon, the flaps on the top and bottom panels and the loops thereon are then rotated about the fold lines connecting the flaps to the top and bottom panels to move most or a substantial part of the inside surfaces of the flaps into engagement with the outside surfaces of said upstanding end panels and move the loops on the inside surfaces of the flaps into engagement with the hooks on the outside surfaces of said upstanding end panels. The hook and loop type fasteners will then firmly connect the flaps to the outside surfaces of the upstanding end panels and will, therefore, hold the panels of the seat or support in tight assembly.

Additional two-part fasteners are positioned on the inside surfaces of the top and bottom panels and on the outside surfaces of the two flaps on the two panels. Positioning fasteners on the outside surfaces of the two upstanding end panels and on the inside surfaces of the two flaps and, at the same time, positioning fasteners on the inside surfaces of the top and bottom panels and on the outside surfaces of the flaps thereon permits the flaps on the top and bottom panels of an assembled and operable seat to be quickly disengaged or separated from the two upstanding end panels and immediately thereafter permits the top and bottom panels to be unfolded or rotated in the reverse direction about the fold lines connecting the top and bottom panels to the upstanding end panels so as to move the original outside surfaces of the top and bottom panels into engagement with the original outside surfaces of the two upstanding end panels whereby all of the panels of the seat or support including all of the panels in the first and second plurality of upstanding load supporting panels can be compressed by hand into a compact bundle or package.

When all of the panels are so compressed, the original outside surfaces and now the inside surfaces of the flaps with the loops thereon are rotated about two fold lines into engagement with the original inside and now outside surfaces of said top and bottom panels with the hooks thereon and with the two-part fasteners then tightly securing the flaps to the original inside and now outside surfaces of said top and bottom panels. The hook and loop type fasteners will then hold all of the panels of the seat or support in tight assembly, as will be discussed in greater detail hereinafter.

When all of the two-part fasteners are positioned as hereinbefore mentioned on the inside surfaces of the top and bottom panels, on the outsides surfaces of the two upstanding end panels, and on both the inside and outside surfaces of the flaps on the ends of the top and bottom panels, the two-part fasteners will permit an assembled and operable seat to be quickly and easily unfolded and thereafter refolded and compressed in a certain manner or sequence which in turn will enable the assembled and operable seat or support to be quickly and easily converted into a tightly secured and self contained compact bundle or package. Said bundle or package can easily be carried, can be used as a seat cushion, or can easily be stored. A shoulder strap can be attached to the tightly secured bundle for ease of carrying or storage.

Accordingly, one object of the present invention is to provide a foldable seat or support made of corrugated plastic.

Another object of the invention is to provide a foldable seat or support which is not susceptible to water or moisture damage.

Another object of the invention is to provide a foldable seat or support which can be folded repeatedly without damaging the fold lines therein or affecting the structural integrity of the seat or support.

Another object of the invention is to provide a foldable seat or support which is light in weight and can carry or support heavy loads.

Another object of the invention is to provide a foldable seat or support structured from one or more blanks cut and scored to provide fold lines and integral and foldable panels which together with certain auxiliary components can quickly and easily be folded into an assembled and operable seat or support.

Another object of the invention is to provide a foldable seat or support structured from one or more blanks cut and scored to provide fold lines and integral and foldable panels which together with certain auxiliary components can quickly and easily be folded into an assembled and operable seat or support and which can also be unfolded and thereafter refolded in a certain manner or sequence to be quickly and easily converted into a tightly secured and self contained compact bundle or package for carrying, for use a seat cushion, or for storage.

Another object of the invention is to provide a foldable seat or support which has a strap attached thereto for ease of carrying or storage.

Still another object of the invention is to provide a foldable seat or support structured from one or more blanks cut and scored to provide fold lines and integral and foldable panels including load supporting panels positioned or prepositioned to evenly and effectively support a load applied to the seat or support.

Other objects and advantages of the invention will become readily apparent from the following description taken in connection with the accompanying drawings wherein, FIG. 1 is a plan view of the first or one of the two blanks utilized in the structure of the preferred embodiment of the foldable seat or support with the surface of the blank as shown constituting the inside surfaces the panels of the blank prior to the panels being folded into an assembled and operable seat and with the blank being shown as cut to size, having slots and recesses cut therein, and being cut and scored to provide fold lines that define integral and foldable panels that can easily and quickly be folded into an assembled and operable seat or support when the blank is connected to or combined with the similarly constructed second blank;

FIG. 2 is a plan view of the second blank with the surface of the blank as shown also constituting the inside surfaces of the panels of the blank prior to the panels being folded into an assembled and operable seat and with the blank being shown as cut to size, having slots and recesses cut therein, and being cut and scored to provide fold lines that define integral and foldable panels that can easily and quickly be folded into an assembled and operable seat or support when the blank is connected to or combined with the first blank;

FIG. 3 is a perspective view illustrating the construction of a sheet of the corrugated plastic;

FIG. 4 is a plan view showing how the first and second blanks are connected at one end with one end of an upstanding load supporting panel on the first blank being connected to the other blank by sonic welding the outside or underneath (as shown) surface of a flap on one side of the second upstanding end panel on the second blank to the inside surface (as shown) of the upstanding load supporting panel on the first blank with the sonic welds being shown as small circles to illustrate the connection;

FIG. 5 is a plan view showing the free or unconnected ends of the two blanks shown in FIG. 4 as being connected again by sonic welding the inside surface (as shown) of one of the upstanding end panels on the second blank to the outside or underneath (as shown) surface of a flap on one side of the first upstanding end panel on the opposite end of the first blank with the sonic welds being shown again as small circles to illustrate the connection;

FIG. 6 is a plan view of the two connected and unfolded blanks of the seat or support prior to the addition or application of auxiliary components thereto with the open bottom portion of the seat or support facing upwardly after the blanks are rotated to an upright position on a flat surface, with the plan view particularly illustrating the initial configuration of the first and second plurality of upstanding load supporting panels and the top and bottom panels with the upper end walls (not shown) of the upstanding load supporting panels being seated on the flat surface, the inside surface (not shown) of the top panel also being positioned face down on the flat surface with the outside surface of the top panel facing upwardly, and with the bottom panel folded rearwardly and extending substantially normal to the upstanding end panel to which it is connected along a fold line;

FIG. 7 is a plan view of a portion of the bottom panel shown in FIG. 6 illustrating an enlargement of one of the two slots in the bottom panel and the flaps thereon and particularly illustrating the shape of the slot;

FIG. 8 is an enlarged partial plan view illustrating some of the structural details of the bottom end wall of one of the upstanding load supporting panels and the first upstanding end panel as shown in FIG. 6, illustrating in particular the upstanding load supporting panel being connected to the flap on one side of the first upstanding end panel, illustrating the open ends of the passages in the corrugated plastic upstanding load supporting panel and in the flap on the first upstanding end panel, and illustrating the ends of the passageways in one of two slots cut into the bottom panel and the first upstanding end panel along the fold line connecting the two panels;

FIG. 9 is an enlargement of a detail showing one of the elongated slots that define the fold lines that foldably connect the upstanding load supporting panels in each plurality of upstanding load supporting panels to each other;

FIG. 10 is and enlarged plan view of a portion of the first blank shown in FIG. 1 illustrating the first upstanding end panel, the bottom panel foldably connected to the upstanding end panel along a fold line, and one of the upstanding load supporting panels foldably connected to one side of the upstanding end panel along a fold line and, in particular, illustrating the construction of the top end wall of the first upstanding end panel with the tabs thereon, and the construction of the first upstanding end panel together with the bottom panel and the upstanding load supporting panel along and adjacent to the fold line connecting the upstanding end panel and the bottom panel, all of which illustrate and emphasize that the length of the upstanding end panel has been slightly increased to change the position of the fold line connecting the upstanding end panel and the bottom panel so that the fold line does not lie in the same horizontal plane as or in a straight line with the bottom wall of the upstanding load supporting panel whereby the bottom panel can be rotated about the fold line without striking or engaging a portion of the lower end wall of the upstanding load supporting panel near the fold line and can thus be rotated about the fold line into coacting engagement with other panels of the seat or support without obstruction to or interference with such rotary movement;

FIG. 11 is an enlarged plan view of a portion of the second blank shown in FIG. 2 illustrating the second upstanding end panel, the top panel foldably connected to the second upstanding end panel along a fold line, and one of the upstanding load supporting panels connected to one side of the upstanding end panel along a fold line and, in particular, illustrating the construction of the bottom end wall of the second upstanding end panel with the tabs thereon, and the construction of the second upstanding end panel together with the top panel and the upstanding load supporting panel along and adjacent to the fold line connecting the upstanding end panel to the top panel, all of which illustrate and emphasize that the length of the second upstanding end panel has been slightly increased to change the position of the fold line connecting the upstanding end panel and the top panel so that the fold line does not lie in the same horizontal plane as or in a straight line with the upper wall of the upstanding load supporting panel whereby the top panel can be rotated about the fold line without striking or engaging a portion of the upper end wall of the upstanding load panel near the fold line and can thus be rotated about the fold line into coacting engagement with other panels of the seat or support without obstruction to or interference with such rotary movement;

FIG. 12 is a side elevation of one of the connectors or straps with the strap terminating at each end in a head having a pin or cylinder extending normal thereto and having a sharpened or pointed end;

FIG. 13 is a top plan view of one of the connectors or straps illustrating the head on each end of the strap and illustrating the integral or one piece construction of the strap;

Figure 5:
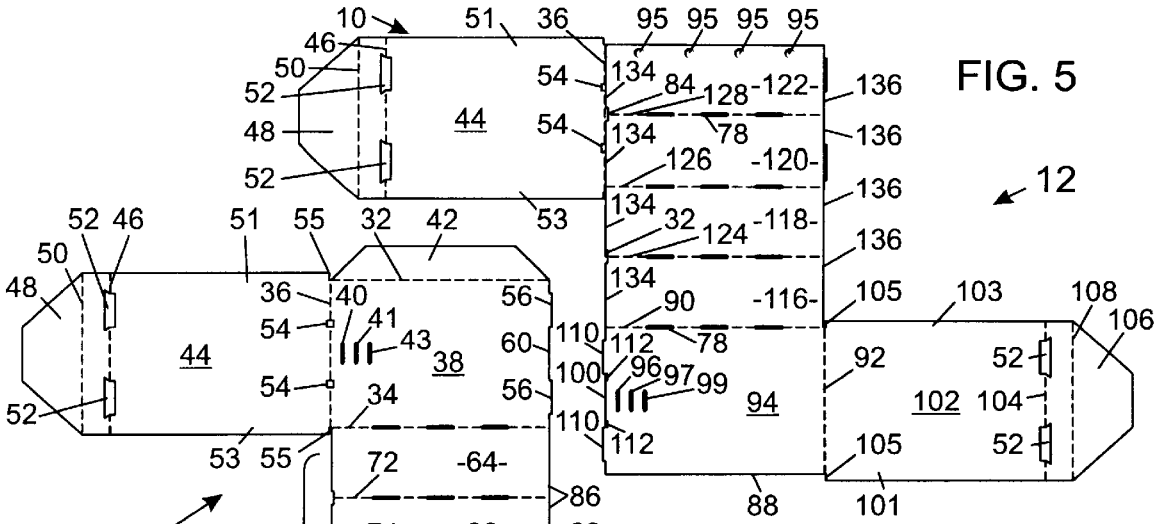
Figures 22, 23, 24:
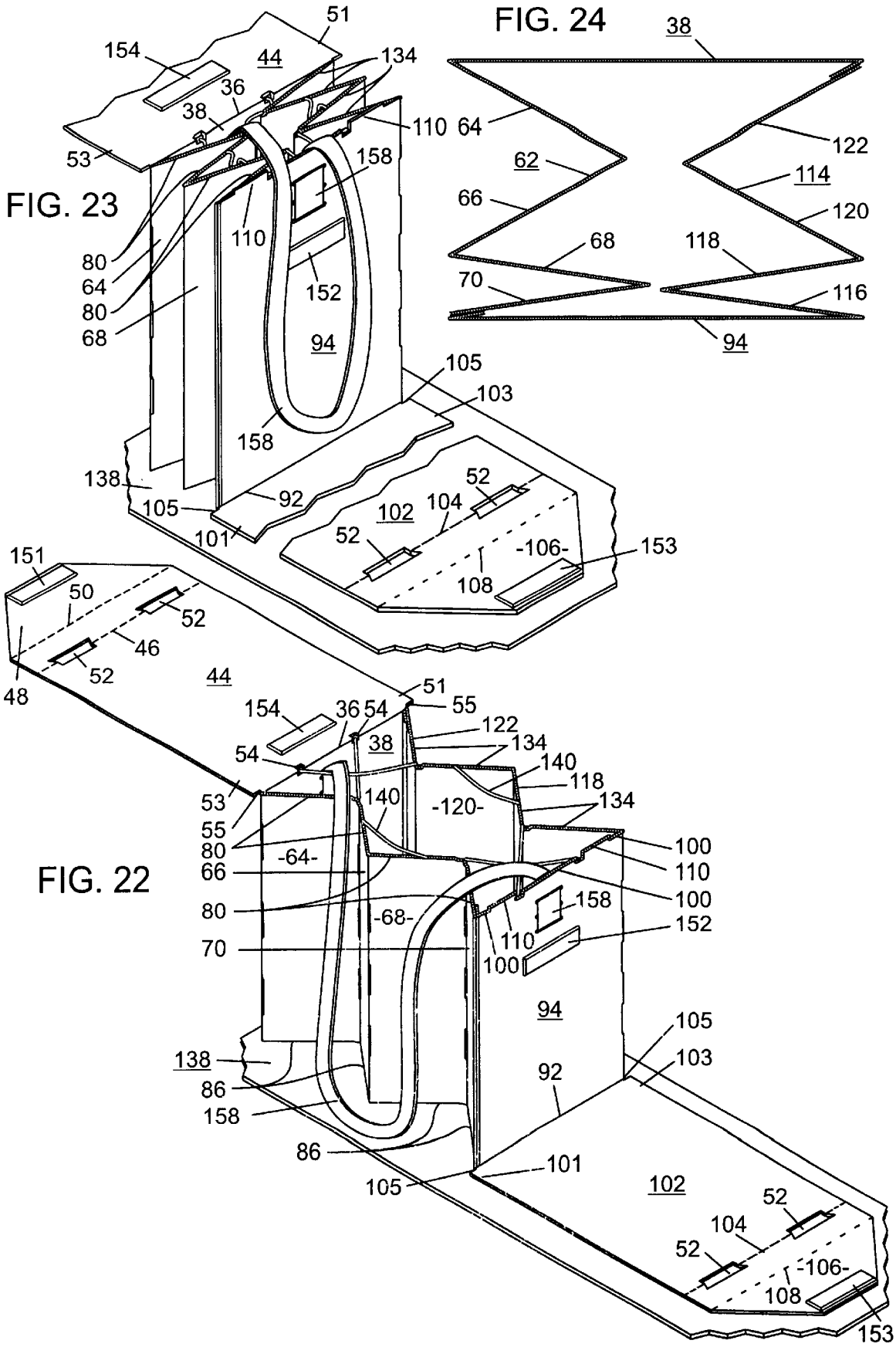
Figure 25:
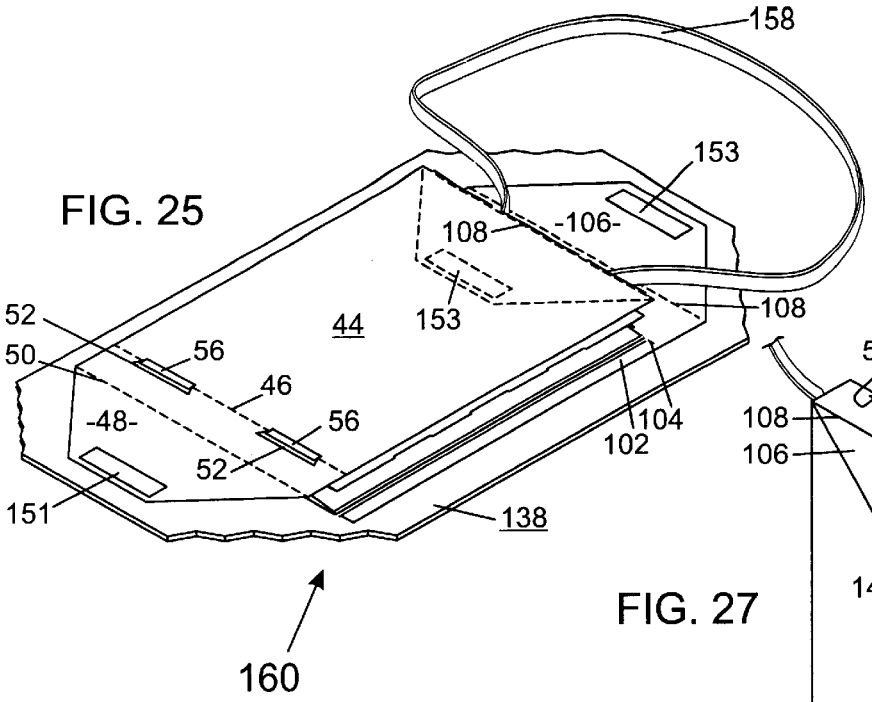
Figure 27:
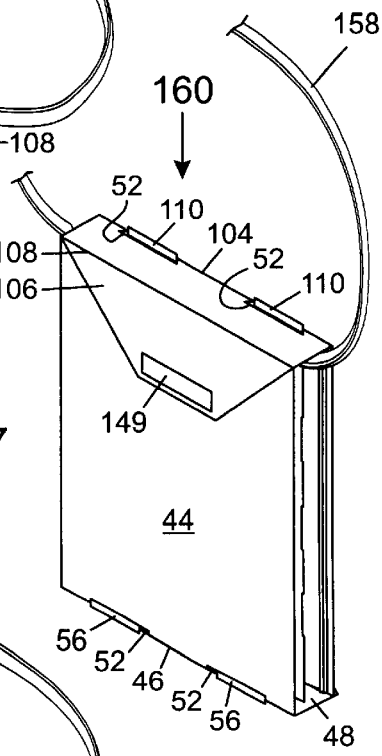
Figure 26:
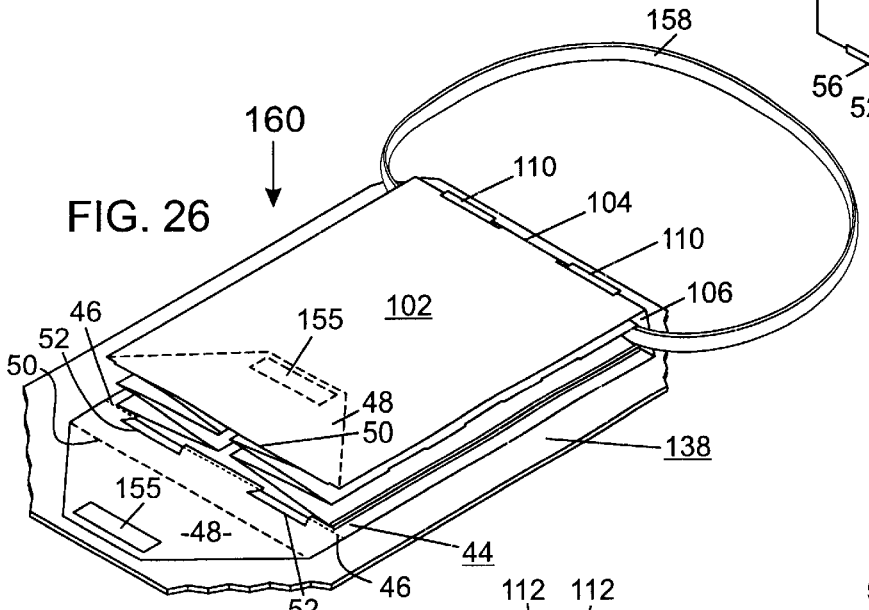
Figure 28:
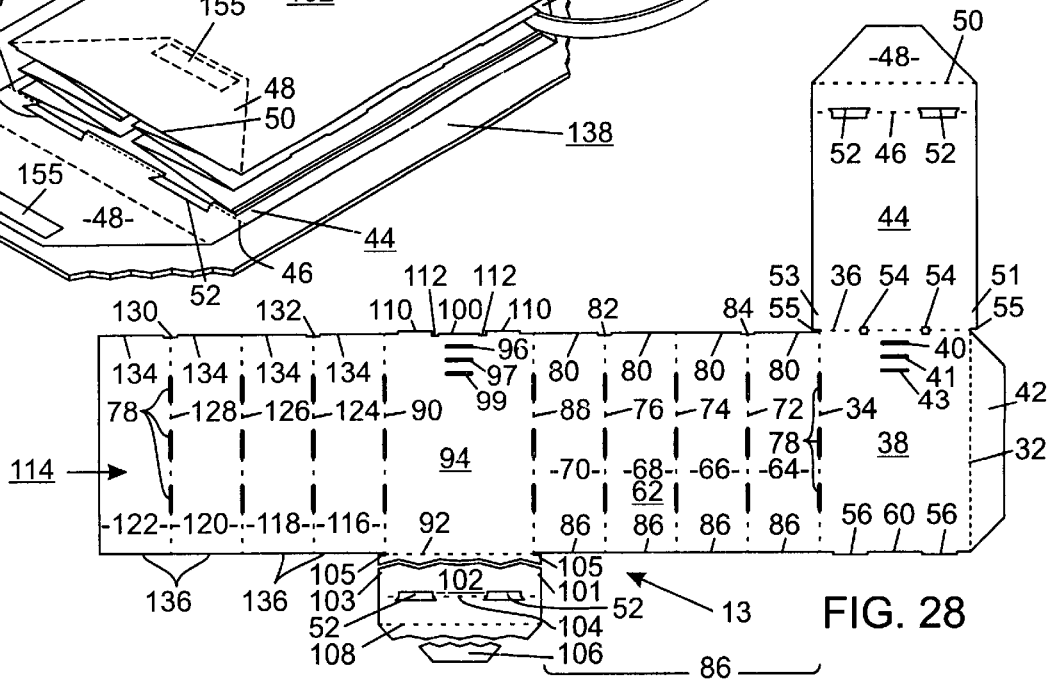

FIG. 14 is a perspective view of the assembled and operable seat as shown in FIG. 16 with the bottom panel facing upwardly and with the bottom panel being released or unlocked from the second upstanding end panel and being folded to a position substantially normal to the first upstanding end panel and along the fold line connecting the bottom panel to the first upstanding end panel to illustrate the structure of the bottom portion of the seat or support and, in particular, the lower ends of the first and second plurality of upstanding load supporting panels, the positions of some of the hook and loop, two-part fasteners, and the connectors or straps with slack therein as a result of the bottom panel being released or unlocked from the second upstanding end panel;

FIG. 15 is a partial perspective view illustrating where and how the connectors or straps are positioned to hold the upstanding load supporting panels and the upstanding end panels in assembly and hold the individual panels of the load supporting panels in a triangular configuration with the panels intersecting each other and the upstanding end panels at angles falling within a preselected range of degrees and with the upstanding load supporting panels being positioned or prepositioned between the upstanding end panels and the top and bottom panels to provide effective load distribution and support to the top and bottom panels;

FIG. 16 is a perspective view of an assembled and operable seat or support with the top panel on the bottom and positioned on a flat surface and with the bottom panel facing upwardly and being mostly cut away and with the flap on the bottom panel receiving the two tabs and being secured to the outside surface of the second upstanding end panel in the same position as the flap in FIG. 18 is secured to the outside surface of the first upstanding end panel;

FIG. 17 is a schematic illustration of the bottom structure of an assembled seat or support, with the top and bottom panels and certain auxiliary components being removed, showing the positions of the connectors or straps as applied to the two upstanding end panels and the first and second plurality of upstanding load supporting panels for connecting the upstanding load supporting panels to the two end panels and to each other so that the panels of the first and second plurality of upstanding load supporting panels intersect each other and the upstanding end panels at angles falling within a preselected range of degrees and at the same time are also positioned or prepositioned between the two upstanding end panels and the top and bottom panels for effectively carrying and efficiently distributing a load applied to the panels of the seat or support;

FIG. 18 is a perspective view of an assembled and operable seat or support ready for intended use positioned with the bottom panel on a flat surface and with the top or seat panel facing upwardly and illustrating the construction of an operable seat or support with the top panel being secured to the first upstanding end panel with the tabs on the upper end of the first upstanding end panel being received in the slots in the top panel and the flap thereon and with the first plurality of upstanding load supporting panels being sonic welded to the second upstanding end panel;

FIG. 19 is a perspective view of the assembled and operable seat as shown in FIG. 18 with the top panel released or unlocked from the second upstanding end panel and folded to a position along a fold line substantially normal to the second upstanding end panel to illustrate the structure of the top portion of the seat and, in particular, the upper ends of the first and second plurality of upstanding load supporting panels, the positions of some of the hook and loop, two-part fasteners, and the two tabs on the upper end wall of the first upstanding end panel;

FIG. 20 is a perspective view of the assembled and operable seat as shown in FIG. 19 with the seat as shown in FIG. 19 being rotated 180 degrees so that the top panel is unfolded and extends in the reverse direction to the top panel as shown in FIG. 19 to illustrate the structure of the top portion of the seat and, in particular, the position of some of the hook and loop, two-part fasteners, positioned on the inside and outside surfaces of some of the panels;

FIG. 21 is a enlarged partial perspective view of the top panel and flap thereon as shown in FIG. 18 illustrating one of the tabs on the top end wall of the first upstanding end panel being seated or received within the slot in the top panel and flap thereon when the flap is tightly secured to the outside surface of the upper portion of the first upstanding end panel;

FIG. 22 is a perspective view of the assembled seat or support positioned on a flat surface with the bottom portion of seat facing upwardly and with the top and bottom panels released from the end panels, with the top panel folded such that the inside surface thereof rests on the flat surface, with the bottom portion of the seat including the connectors or straps facing upwardly and having slack therein, and with the loop of a shoulder strap being positioned outside of the seat structure;

FIG. 23 is a partial perspective view of the assembled seat or support as shown in FIG. 22 with the two upstanding end panels being partially compressed toward each other to start folding the upstanding load supporting panels into a tight or compact bundle and with the inside surface of the top panel being unfolded and positioned on a flat surface as shown both in FIGS. 22 and 23;

FIG. 24 is a diagrammatic view of the upstanding load supporting panels being folded or compressed between the two upstanding end panels and illustrating that the individual panels of the upstanding load supporting panels are dimensioned so that the inner ends of the panels when the panels are compressed or folded flat will not touch or interfere with each other and thus will insure that the panels can be compressed into a tight and compact bundle;

FIG. 25 is a perspective view illustrating the seat or support as shown in FIG. 23 with the two end panels and the compressed bundle of load supporting panels having been folded or rotated downwardly and clockwise into engagement with the original outside and now inside surface of the top panel which is facing upwardly with the other or original inside and now outside surface of the panel being positioned on a flat surface and with the loop portion of the shoulder strap being positioned so as to permit the flap on the end of the top panel to be rotated into engagement with the original inside and now outside surface of the bottom panel whereby the hook and loop fasteners will tightly secure the flap to the original inside and now outside surface of the bottom panel as shown in dotted lines and hold the bundle of panels in tight assembly;

FIG. 26 is a perspective view showing the seat of FIG. 25 rotated 180 degrees about it's longitudinal axis so that the flap on the bottom panel with the loop portion of the fastener on the original outside and now the inside surface thereof can be rotated into engagement with the hook portion of the fastener on the original inside and now outside surface of the top panel as shown in dotted lines to hold the bundle of panels in a tight and compact bundle and hold all of the panels in tight assembly;

FIG. 27 is a perspective view showing the tightly secured and self contained compact bundle of FIG. 26 with the shoulder strap positioned for carrying the tight and compact bundle by hand or by suspension from a shoulder; and FIG. 28 is a plan view of a single blank rather than two blanks that can be utilized to construct or form the seat or support of the present invention with the single blank being cut to combine two blanks into one and with the single blank being identical in construction and configuration to the two blank version, with the exception that it has only one flap on one side of only one upstanding end panel for connecting the opposite ends of the single blank, instead of having one flap each on one side of two upstanding end panels as are required to connect the blanks in the two blank version.

DESCRIPTION OF THE PREFERRED EMBODIMENT OF THE INVENTION

Referring now to the drawings wherein like reference numerals refer to like panels and auxiliary components throughout, FIG. 1 and FIG. 2 show the preferred embodiment of the seat or support of the present invention as including two flat blanks, a first blank 10 as shown in FIG. 1 and a second blank 12 as shown in FIG. 2. The two blanks are made from sheets of corrugated plastic and the structure of the corrugated plastic is shown in FIG. 3, as will be discussed more in detail hereinafter in connection with the description of FIG. 3. The seat or support could be made or constructed from a single blank instead of two blanks and the use of a single blank in such construction will be discussed in detail hereinafter in connection with FIG. 28.

The surface of the first blank 10 as shown constitutes the inside surfaces of the panels of the seat or support prior to being folded into an assembled and operable seat after the blank is connected to or combined with the second blank. The first blank 10 is shown as cut to size, having slots and recesses cut therein, and being cut and scored to provide fold lines that define integral and foldable panels that together with the auxiliary components (not shown) associated therewith can quickly and easily be folded into an assembled and operable seat or support, again, when the blank 10 is connected to or is combined with the second blank 12.

The surface of the second blank 12 as shown also constitutes the inside surfaces of the panels of the seat or support prior to being folded into an assembled and operable seat, again, when the blank 12 is connected to or combined with the first blank 10.The second blank is also shown as being cut to size, having slots and recessed cut therein, and being cut and scored to provide fold lines that also define integral and foldable panels that, together with the auxiliary components (not shown) associated therewith, can quickly and easily be folded into an assembled and operable seat or support when the blank is connected to or combined with the first blank.

The two blanks 10 and 12 are made of sheets of corrugated plastic, the structural details of which are illustrated in FIG. 3. The corrugated plastic consisting of polypropylene copolymers is extruded into corrugated plastic sheets, and such a sheet 14 as shown in FIG. 3 is comprised of twin panels 16 and 18 of said plastic integrally connected by a plurality of longitudinally extending ribs or flutes 20 that define a plurality of longitudinally extending passageways 22 extending the length of the corrugated plastic sheet.

The flutes or ribs 20 have a predetermined width and are spaced a preselected distance apart with the flutes 20 in combination with the twin panels 16 and 18 defining or creating the longitudinally extending passageways 22.The end wall of the corrugated plastic sheet shown in FIG. 3 is comprised of the end walls 26 and 28 of the panels 16 and 18, respectively, and the end walls 30 of the flutes with the three end walls 26, 28, and 30 in combination defining or establishing the exposed ends of the longitudinally extending passageways 22.The ends of the passageways are exposed at both ends of the corrugated plastic sheet 14 and also when the corrugated plastic sheet is cut transversely or at an angle, or when said plastic sheet is otherwise cut, recessed or slotted.

The sheets of corrugated plastic utilized in this preferred embodiment of the invention each have a thickness of 4.0 millimeters and have a weight of 1000 grams per square meter. The sheets of corrugated plastic utilized in this preferred embodiment of the invention are also identified and sold in the commercial open market under the trademark COROPLAST®. COROPLAST® is a registered trademark owned by Coroplast, Inc. Sheets of corrugated plastic having other thicknesses and weights can also be utilized in the construction of the seat or support, and the use of such other structural combinations together with the advantages and disadvantages thereof will be determined by such factors as the intended environmental application and the performance requirements imposed on the seat or support.

Utilizing corrugated plastic in the construction of the seat or support of the present invention has some distinct advantages over other materials such as cardboard used in the construction of prior art seats or supports. Corrugated plastic is waterproof and thus is not susceptible to water or moisture damage. A seat or support constructed of corrugated plastic can be used outdoors without fear of rain or water damage or loss of structural integrity stemming therefrom. Corrugated plastic is also light in weight and can support heavy loads. An assembled and operable seat or support constructed of corrugated plastic in accordance with the preferred embodiment of the present invention weights only 2.3 pounds, or 2.4 pounds with a carrying strap attached thereto. A seat or support made of corrugated plastic can also be folded and refolded repeatedly over a long period of time into an assembled and operable seat or support and into a self contained compact bundle or package for carrying or storage without damage to the fold lines defining the panels of the seat or support. After repeated bending, the fold lines will not disintegrate or become weakened and thus will not lose their structural integrity or interfere with the continued function or use of the seat or support.

Referring now to FIG. 1, the first blank 10 is shown as a flat blank or sheet of corrugated plastic with the surface of the blank as shown constituting the inside surfaces of the panels of the seat or support prior to being folded into an assembled and operable seat or support. The blank 10 is shown as cut to size, having slots and recesses cut therein, and being cut and scored to provide fold lines that define integral and foldable panels that can, together with the auxiliary components associated therewith, quickly and easily be folded into an assembled and operable seat or support when the blank is connected to or combined with the second blank 12.

As discussed above in connection with the description of blank 10, when the two blanks 10 and 12 are connected or combined, the integral and foldable panels of both blanks, together with the auxiliary components associated therewith, can quickly and easily be folded along fold lines into a tightly assembled and operable seat or support or can quickly and easily be disassembled and refolded in a certain manner or sequence for a quick conversion into a tightly secured and self contained compact bundle or package for carrying, for use as a seat cushion, or for storage. Moreover, as also discussed hereinbefore, all of the panels and auxiliary components of the seat or support as well as the assembly thereof into an assembled and operable seat or support or the disassembly and refolding thereof in a certain manner or sequence for a quick conversion into a tightly secured and compact bundle or package will be described both from a structural and a functional standpoint and will be further described concerning the structural details and the positioning of the panels and auxiliary components in the detailed description of the preferred embodiment of the invention immediately set forth hereinafter.

Blank 10 includes fold lines 32, 34 and 36 which define or establish one of the panels of the seat or support, a first upstanding end panel 38, which end panel 38 along with other panels of both blanks as well as the auxiliary components associated therewith will ultimately be folded and combined into a tightly assembled and operable seat or support. Upstanding end panel 38 has three small, spaced, parallel and elongated slots 40-41-43 therein which can be used to anchor or hold one end of a shoulder strap (not shown) threaded through the slots. The three slots 40-41-43 are substantially centered in panel 38 between fold lines 32 and 34 and located a short and preselected distance from fold line 36. A flap 42 is integrally and foldably connected to one side of upstanding end panel 38 along fold line 32 and the flap 42 serves as a means for connecting two ends of the two blanks 10 and 12, as will be discussed more in detail in connection with the discussion of FIGS. 4 and 5.

A bottom panel 44 is integrally and foldably connected at one end to upstanding end panel 38 along fold line 36. Bottom panel 44 terminates at the opposite end in a fold line 46. A flap 48 is integrally and foldably connected at one end to bottom panel 44 along fold line 46 and the flap 48 includes a second fold line 50 therein, which is spaced a preselected distance from fold line 46 and divides the flap 48 into two parts or portions. The portion of flap 48 between the two fold lines 46 and 50 has the same width as the bottom panel 44, and at fold line 50 is tapered inwardly at both ends so that the portion of the flap extending beyond fold line 50 assumes a trapezoidal shape. The flap 48 has a preselected length and the function and purpose thereof as well as the function and purpose of the two fold lines 46 and 50 will be further discussed hereinafter.

As best shown in FIGS. 1, 8, 10, 14, 15, 22, and 23, bottom panel 44 along fold line 36 is slightly greater in width than upstanding end panel 38 and thus extends laterally beyond fold lines 32 and 34 to provide overhang portions 51–53 on the bottom panel 44 along both sides thereof that extend substantially the entire length of bottom panel 44.

When the two blanks 10 and 12 are combined and are thereafter transformed or folded into an assembled and operable seat, the overhang portions 51–53, as best shown in FIGS. 9, 14, 15, 18, 20, 22 and 23, extend beyond or overhang the lower end walls 80 and 134 (in brackets in FIGS. 1 and 2) or the plurality of lower end walls 80—80—80—80 and 134—134—134—134 of the folded triangular-configuration panels as well as the apexes of the triangles formed thereby (to be discussed hereinafter) in the first and second plurality of upstanding load supporting panels 62 and 114. The overhang portions 51–53 also overhang or extend beyond the sides of upstanding end panel 38 as defined by fold lines 32 and 34, as will be discussed more in detail hereinafter.

As best shown in FIGS. 1 and 10, the overhang portions 51–53 are cut or reduced in length at their inner ends by a preselected amount or dimension so that the inner ends of the overhang portions are parallel with fold line 36 and are spaced a preselected distance from fold line 36 or fold line 36 extended. The overhang portions 51–53 not only are cut and shortened but also are cut in bottom panel 44 to a preselected depth and, at this preselected depth, are each cut at a right angle to form a short end wall on opposite sides of bottom panel 44, both of which end walls have a preselected length and both of which intersect fold line 36 at the point where fold line 36 intersects fold lines 32 and 34. Expressed in another manner, the short end walls are in alignment with or coincide with fold lines 32 and 34.

So cutting the ends of the overhang portions 51–53 when blank 10 is cut and scored will result in the formation of a pair of slots or recesses 55—55 at the ends of fold line 36. Both of the recesses 55—55 are bisected by fold line 36 to provide a preselected distance between fold line 36 and the inner ends of the overhang portions 51–53 and an identical preselected distance between fold line 36 and the lower end walls 80 and 134 of the first and second plurality of upstanding load supporting panels 62 and 114. The slots 55—55 and the surrounding structure resulting therefrom will be further discussed hereinafter in connection with the detailed discussion of FIGS. 1 and 10.

The overhang portions 51–53 are also included as part of bottom panel 44 to improve the appearance of the assembled and operable seat or support, and also function as a barrier or shield to protect the user of the seat or support from scratches or abrasions. Specifically, the overhang portions 51–53 will shield the user's legs from the pointed apexes of the two outwardly extending triangles in the first and second plurality of upstanding load supporting panels 62 and 114. Reducing the length of the overhang portions 51–53 at their inner ends will also provide some space between the inner ends of the overhang portions and fold line 36 and fold lines 32 and 34 which in turn will prevent the inner ends of the overhangs portions 51–53 from repeatedly being struck or bumped and thus being bent or damaged during usage of the seat or support.

As best shown in FIGS. 1 and 7, bottom panel 44 and flap 48 along fold line 46 have two slots 52—52 cut therein along and on both sides of fold line 46, an enlarged view of one slot 52 being shown in FIG. 7. On the bottom panel side of fold line 46, the slot 52 is rectangular in shape and on the flap side of fold line 46 is flared outwardly at an angle in trapezoidal form for a purpose to be discussed hereinafter. A pair of small square-shaped slots 54—54 are cut into the blank 10 and are spaced a preselected distance apart. As shown in FIGS. 1, 6, 8 and 10, the slots 54—54 are cut into both the upstanding end panel 38 and the top panel 44 and are positioned half and half on both sides of the fold line 36. As best shown in FIG. 8, the two slots 54—54 expose the open ends of the passageways 22 in the corrugated plastic upstanding end panel 38. The purpose of the slots 54—54 will be further discussed hereinafter.

First upstanding end panel 38 includes two tabs 56—56 extending from the top end wall 60 thereof and the two tabs are formed integral with the end wall 60. Tabs 56—56 have a predetermined length and width (height) and are spaced a preselected distance apart. The tabs 56—56 are equal in length and in this instance each has a length of 2.5 elevenths of the width of the upstanding end panel 38. The two tabs 56—56 are spaced apart at their inner ends by $^{4}/_{11}$ths of the width of the panel 38 and at their outside ends are each spaced from the sides of the panel 38 or from fold lines 32 and 34 by $^{1}/_{11}$th of the width of the upstanding end panel 38. The importance of the dimensions and positions of the two tabs 56—56 will be further discussed hereinafter.

A first plurality of upstanding load supporting panels 62 consisting of four panels 64, 66, 68 and 70 is integrally and foldably connected to upstanding end panel 38 along fold line 34. The four panels 64, 66, 68 and 70 are equal in width and length, and the length of the panels in this instance is slightly less than the length (height) of the upstanding end panel 38, as will be further discussed in detail hereinafter. One of the four panels 64 is integrally and foldably connected to upstanding end panel 38 along fold line 34 and all four of the upstanding load supporting panels 64, 66, 68 and 70 are integrally and foldably connected to each other along fold lines 72, 74 and 76. The three fold lines 72, 74 and 76 along with fold line 34 are established in this instance by cutting three aligned and elongated slots 78 having curved ends (enlarged view of one slot 78 shown in FIG. 9) into and through the elongated passageways 22 in the corrugated plastic.

The slots 78 thus define the fold lines 34, 72, 74 and 76 and, at the same time, the fold lines define the width of each load supporting panel 64, 66, 68 and 70 with the width of each panel as hereinbefore mentioned being equal. The slots 78 are aligned and spaced a preselected distance apart along the length of each fold line and the slots 78 extend through the corrugated plastic and appear on both sides of the twin panels 16 and 18 of the corrugated plastic sheet. The elongated slots 78 not only define the four fold lines 34, 72, 74 and 76 but the curved ends thereof also prevent the twin sheets 16 and 18 of the corrugated plastic from tearing when a load is applied to the assembled and operable seat or support.

The first plurality of upstanding load support panels 62, as shown in the blank 10 in FIG. 1, has a lower end wall 80 (in bracket) and, when blank 10 is combined with blank 12 and thereafter transformed or folded into an assembled and operable seat or support 11 as shown in FIGS. 14, 15, 16 and 18, the lower end wall 80 will be divided into four separate end walls 80—80—80—80 or a separate end wall 80 on the lower end of each of the upstanding load supporting panels 64, 66, 68 and 70 when the upstanding load support panels are folded into a triangular configuration for supporting a load.

As best seen in FIG. 1, the first plurality of upstanding load supporting panels 62 also has an upper end wall 86 (in bracket), which when the blank 10 is cut to size, constitutes an extension of the top end wall 60 of the first upstanding end panel 38, the two end walls 60 and 86 thus extending in a straight line. When the blank 10 is combined with blank 12 and thereafter transformed or folded into an assembled and operable seat or support 11 as shown in FIGS. 14, 15, 16 and 18, the upper end wall 86 will likewise be divided into four separate end walls 86—86—86—86 or an end wall 86 on the upper end of each of the upstanding load supporting panels 64, 66, 68 and 70 when the upstanding load support panels are folded into a triangular configuration for supporting a load. The lower end wall 80 is recessed at 82 and 84 for a short length and depth on both sides of the point where fold lines 72 and 76 intersect the lower end walls 80—80 of upstanding load supporting panels 64–66 and 68–70 (see enlarged detail view in FIG. 9 showing end walls 80—80, recess 82, fold line 76 and panels 68–70), the purpose of the recesses 82 and 84 also to be discussed in more detail hereinafter.

As best shown in FIGS. 1 and 10, the length or height of upstanding end panel 38 is slightly longer than the length of upstanding load supporting panel 64 connected to one side of end panel 38 along fold line 34 and is also slightly longer than the length of upstanding load supporting panel 122 (shown in phantom) connected to the flap 42 which is integrally connected to upstanding end panel 38 along fold line 32. Upstanding load supporting panel 122 (shown in phantom) is not actually or in fact connected to flap 42 in FIG. 10 which is a plan view of the upstanding end panel 38 and the top panel 44 together with one upstanding load supporting panel 64, all of which are shown in blank 10 or in the plan view of FIG. 1.

The upstanding load supporting panel 122 is shown in phantom in this instance to illustrate that all of the upstanding load supporting panels in each plurality of upstanding load supporting panels 62 and 114 connected to upstanding end panel 38 are slightly less in length than the length of upstanding end panel 38. Upstanding load supporting panel 122 will not, however, actually or in fact be connected to upstanding load supporting panel 38 until blanks 10 and 12 are combined or connected together. FIGS. 5 and 10 both show upstanding load supporting panel 122 connected to flap 42 with the end wall of the free end of upstanding load supporting panel 122 aligned or coinciding with fold line 32 and with the upper end wall 136 of upstanding load supporting panel 122 lying in the same plane as the top end wall 60 of upstanding end panel 38. In this position, it will be noted that the length of panel 122 is the same as the length of flap 42 and that the lower end wall 34 of the panel 122 lies in the same plane as the lower end wall 80 of upstanding load supporting panel 64, all of which again vividly illustrates that upstanding end panel 38 is slightly longer in length that the lengths of upstanding end panels 64 and 122.

Again referring to FIGS. 1 and 10 the longer length of end panel 38 changes the position of fold line 36 relative to the lower end wall 80 of the load supporting panel 64 and similarly changes the position of fold line 36 relative to the lower end wall 134 of the load supporting panel 122 or, as expressed in another manner, insures that the fold line 36 does not lie in the same horizontal plane as or in a straight line with the lower end walls 80 and 134. So changing the position of fold line 36 insures that bottom panel 44 can be rotated about fold line 36 without striking or engaging a portion of the lower end walls 80 and 134 near fold line 36 and can thus be rotated about fold line 36 into coacting engagement with other panels of the seat or support without obstruction to or interference with such rotary movement.

In this particular instance, the length or height of upstanding end panel 38 exceeds the length or height of upstanding load supporting panels 64 and 122 by 3⁄32 of an inch or by slightly more than one-half of the thickness of the corrugated plastic sheet (2 millimeters). The slots 55—55 are also cut to remove 3⁄32 of an inch of material, as measured from fold line 36, from the ends of the overhang portions 51–53 so that the distance between the lower end walls 80 and 134 of the upstanding load supporting panels 64 and 122 and the end walls 57–59 of the overhang portions 51–53 created by the slots 55—55 is 3⁄16 of an inch, 3⁄32 of an inch from the lower end walls 80 and 134 to fold line 36 plus 3⁄32 of an inch from the end walls 57 and 59 to the fold line 36. With the fold line 36 being so positioned, the bottom panel 44 can be rotated without obstruction about fold line 36 and can thereby seat flat on the lower end walls 80—80—80—80 and 134—134—134—134 of the first and second plurality of upstanding load supporting panels 62 and 114 and on the bottom end wall 100 of the second upstanding end panel 94 when all of the panels and auxiliary components are folded into an assembled and operable seat or support.

Referring now to FIG. 2, the second blank 12 is also shown as a flat blank or sheet of corrugated plastic with the surface of the blank as shown constituting the inside surfaces of some of the panels and other components of the seat or support prior to being folded into an assembled and operable seat or support. The blank 12 is also shown as cut to size, having slots and recesses cut therein, and being cut and scored to provide fold lines that define integral and foldable panels that can, together with the auxiliary components associated therewith, quickly and easily be folded into an assembled and operable seat or support when the second blank 12 is connected to or combined with the first blank 10.

When the two blanks 12 and 10 are connected or combined, the integral and foldable panels of both blanks, together with the auxiliary components associated therewith, can quickly and easily be folded along fold lines into a tightly assembled and operable seat or support or can quickly and easily be disassembled and refolded in a certain manner or sequence for a quick conversion into a tightly secured and self-contained compact bundle or package for carrying, for use as a seat cushion, or for storage. Moreover, as also discussed hereinbefore, all of the panels and auxiliary components of the seat or support as well as the assembly thereof into an assembled and operable seat or support or the disassembly and refolding thereof in a certain manner or sequence for a quick conversion into a tightly secured and compact bundle or package will be described both from a structural and functional standpoint and will be further described concerning the structural details and the positioning of the panels and auxiliary components in the detailed description of the preferred embodiment of the invention immediately set forth hereinafter.

As best shown in FIG. 2, blank 12 includes fold lines 88, 90 and 92 which define or establish another of the panels of the seat or support, a second upstanding end panel 94, which end panel 94 along with other panels and components of both blanks as well as the auxiliary components associated therewith will ultimately be folded and combined into a tightly assembled and operable seat or support. Upstanding end panel 94 has three small, spaced, parallel and elongated slots 96-97-99 therein which can be used to anchor or hold one end of a shoulder strap (not shown) threaded through the slots. The three slots 96-97-99 are substantially centered in panel 94 between fold lines 88 and 90 and located a short and preselected distance from the bottom end wall 100 of second upstanding end panel 94. A flap 98 is integrally and foldably connected to one side of upstanding end panel 94 along fold line 88, and the flap 98 serves as a means for connecting two ends of the two blanks 12 and 10, as will be discussed more in detail in connection with the discussion of FIGS. 4 and 5.

A top panel 102 is integrally and foldably connected at one end to upstanding end panel 94 along fold line 92. Top panel 102 terminates at the opposite end in a fold line 104. A flap 106 is integrally and foldably connected at one end to top panel 102 along fold line 104 and the flap 106 includes a second fold line 108 therein which is spaced a preselected distance from fold line 104 and divides the flap 106 into two parts or portions. The portion of flap 106 between the two fold lines 104 and 108 has the same width as the top panel 102, and at fold line 108 is tapered inwardly at both ends so that the portion of the flap extending beyond fold line 108 assumes a trapezoidal shape. The flap 106 has a preselected length and the function and purpose thereof as well as the function and purpose of the two fold lines 104 and 108 will be further discussed hereinafter.

As best shown in FIGS. 2, 11, 18, 19 and 20, top panel is slightly greater in width than upstanding end panel 94 and thus extends laterally beyond fold lines 88 and 90 to provide overhang portions 101–103 on top panel 102 along both sides thereof that extend substantially the entire length of top panel 102.

When the two blanks 12 and 10 are combined and are thereafter transformed or folded into an assembled and operable seat or support, the overhang portions 101–103 of top panel 102, as best shown in FIGS. 11, 18, 19 and 20, extend beyond or overhang the upper end walls 86 and 136 (in brackets in FIGS. 2 and 11) or the plurality of end walls 86—86—86—86 and 136—136—136—136 of the folded triangular-configuration panels as well as the apexes of the triangles formed thereby (to be discussed hereinafter) in the first and second plurality of upstanding load supporting panels 62 and 114. The overhang portions 101–103 also overhang or extend beyond the sides of the second upstanding end panel 94 defined by fold lines 88 and 90, as will be discussed more in detail hereinafter.

As best shown in FIGS. 2 and 11, the overhang portions 101–103 are cut or reduced in length at their inner ends by a preselected amount or dimension so that the inner ends of the overhang portions are parallel with fold line 92 and are spaced a preselected distance from fold line 92 or fold line 92 extended. The overhang portions 101–103 not only are cut and shortened but also are cut in top panel 102 to a preselected depth and, at this preselected depth, are each cut at a right angle to form a short end wall on opposite sides of top panel 102, both of which end walls have a preselected length and both of which intersect fold line 92 at the point where fold line 92 intersects fold lines 88 and 90. Expressed in another manner, the short end walls are in alignment with or coincide with fold lines 88 and 90.

So cutting the ends of the overhang portions 101–103 when blank 12 is cut and scored will result in the formation of a pair of slots or recesses 105—105 at the ends of fold line 92. Both of the recesses 105—105 are bisected by fold line 92 to provide a preselected distance between fold line 92 and the inner ends of the overhang portions 101–103 and an identical preselected distance between fold line 92 and the upper end walls 86 and 136 of the first and second plurality of upstanding load supporting panels 62 and 114. The slots 105—105 and the surrounding structure resulting therefrom will be further discussed hereinafter in connection with the detailed discussion of FIGS. 2 and 11.

The overhang portions 101–103 are also included as part of top panel 102 to improve the appearance of the assembled and operable seat or support, and also function as a barrier or shield to protect the user of the seat or support from scratches or abrasions. Specifically, the overhang portions 101–103 will shield the user's legs from the pointed apexes of the two outwardly extending triangles in the first and second plurality of upstanding load supporting panels 62 and 114. Reducing the length of the overhang portions 101–103 at their inner ends will also provide some space between the inner ends of the overhang portions and fold line 92 and fold lines 88 and 90 which in turn will prevent the inner ends of the overhangs portions 101–103 from repeatedly being struck or bumped and thus being bent or damaged during usage of the seat or support.

Figure 6:
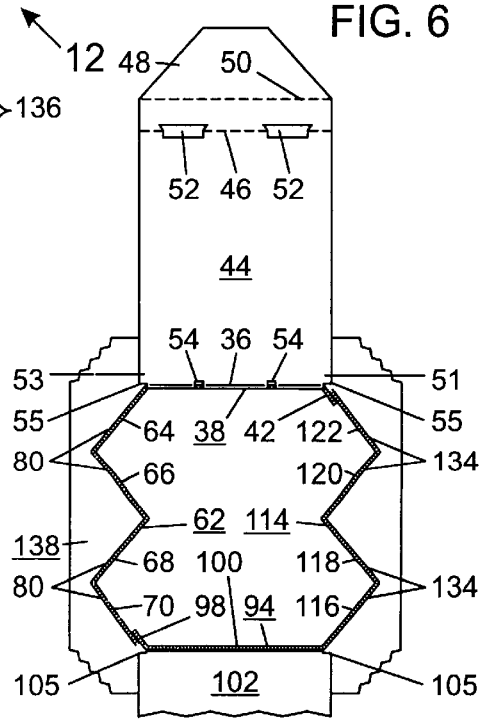

As best shown in FIGS. 2 and 7, top panel 102 and flap 106 along fold line 104, as in bottom panel 44 in FIG. 1, also have two slots 52—52 therein along and on both sides of fold line 104, an enlarged view of one slot 52 being shown in FIG. 6. On the top panel side of fold line 104, the slot 52 is rectangular in shape and on the flap side of fold line 104 is flared outwardly at an angle in trapezoidal form, also for a purpose to be discussed hereinafter.

Second upstanding end panel 94 includes two tabs 110—110 extending from the bottom end wall 100 thereof and the two tabs are formed integral with the end wall 100. Tabs 110—110 have a predetermined length and width (height) and are spaced a preselected distance apart. A pair of recesses 112—112 are cut into the end wall 100 at the inner ends of tabs 110—110, for a purpose also to be discussed hereinafter. The tabs 110—110 are equal in length and in this instance each has a length of 2.5 elevenths of the width of the upstanding end panel 94. The two tabs 110—110 are spaced apart at their inner ends by $^{4}/_{11}$ths of the width of the panel 38 and at their outside ends are each spaced from the sides of panel 94 or from fold lines 88 and 90 by $^{1}/_{11}$th of the width of the upstanding end panel 94. The importance of the dimensions and positions of the two tabs 110—110 will be further discussed hereinafter.

A second plurality of upstanding load supporting panels 114 consisting of four panels 116, 118, 120 and 122 is integrally and foldably connected to upstanding end panel 94 along fold line 90. The four panels 116, 118, 120 and 122 are equal in width and length, and the length of the panels is slightly less than the length (height) of the upstanding end panel 94, as will be further discussed in detail hereinafter. One of the four panels 116 is integrally and foldably connected to upstanding end panel 94 along fold line 90 and all four of the upstanding load supporting panels 116, 118, 120 and 122 are integrally and foldably connected to each other along fold lines 124, 126 and 128. The three fold lines 124, 126 and 128 along with fold line 90 are established in this instance by cutting three aligned and elongated slots 78 having curved ends (enlarged view of one slot 78 shown in FIG. 5) into and through the elongated passageways 22 in the corrugated plastic.

The slots 78 thus define the fold lines 90, 124, 126 and 128 and, at the same time, the fold lines define the width of each load supporting panel 116, 118, 120 and 122 with the width of each panel as hereinbefore mentioned being equal. The slots 78 are aligned and spaced a preselected distance apart along the length of each fold line and the slots 78 extend through the corrugated plastic and appear on both sides of the twin panels 16 and 18 of the corrugated plastic sheet. The elongated slots 78 not only define the four fold lines 90, 124, 126 and 128 but the curved ends thereof also prevent the twin sheets 16 and 18 of the corrugated plastic from tearing when a load is applied to the assembled and operable seat.

The second plurality of upstanding load support panels 114, as shown in the blank 12 in FIG. 2, has a lower end wall 134 (in bracket) and, when blank 12 is combined with blank 10 and thereafter transformed or folded into an assembled and operable seat or support 11 as shown in FIGS. 18, 19, 20 and 21, the lower end wall 134 (FIG. 2) will be divided into four separate end walls 134—134—134—134 or a separate end wall 134 on the lower end of each of the upstanding load supporting panels 116, 118, 120 and 122 when the upstanding load support panels are folded into a triangular configuration for supporting a load. The lower end wall 134 is recessed at 130 and 132 for a short length and depth on both sides of the point where fold lines 124 and 128 intersect the lower end walls 134—134 of upstanding load supporting panels 116–118 and 120–122 (see enlarged detail view of FIG. 9 showing the identical recess construction in the lower end walls 80—80 in blank 10 of FIG. 1), the purpose of the recesses 130 and 132 also to be discussed more in detail hereinafter.

The second plurality of upstanding load supporting panels 114 as shown in FIG. 2 also has an upper end wall 136, which when the blank 12 is cut, does not constitute an extension of the fold line 92 of the first upstanding end panel 94. The end wall 136 and the fold line 92 do not extend in a straight line or lie in the same plane because the upstanding end panel 94 is slightly longer in length that the length of each of the upstanding load supporting panels 116, 118, 120 and 122. When the blank 12 is combined with blank 10 and thereafter transformed or folded into an assembled and operable seat or support 11 as shown in FIGS. 18, 19 and 20, the upper end wall 136 (FIG. 2) will likewise be divided into four separate end walls 136—136—136—136 (FIG. 2) or an end wall 136 on the upper end of each of the upstanding load supporting panels 116, 118, 120 and 122 when the upstanding load support panels are folded into a triangular configuration for supporting a load.

As best shown in FIGS. 2 and 11, the length or height of upstanding end panel 94 is slightly longer than the length of upstanding load supporting panel 116 connected to one side of end panel 94 along fold line 90 and is also slightly longer than the length of upstanding load supporting panel 70 (shown in phantom) connected to the flap 98 which is integrally connected to upstanding end panel 94 along fold line 88. Upstanding load supporting panel 70 (shown in phantom) is not actually or in fact connected to flap 98 in FIG. 11 which is a plan view of the upstanding end panel 94 and the top panel 102 together with one upstanding load supporting panel 116, all of which are shown in blank 12 or in the plan view of FIG. 2.

Figure 4:
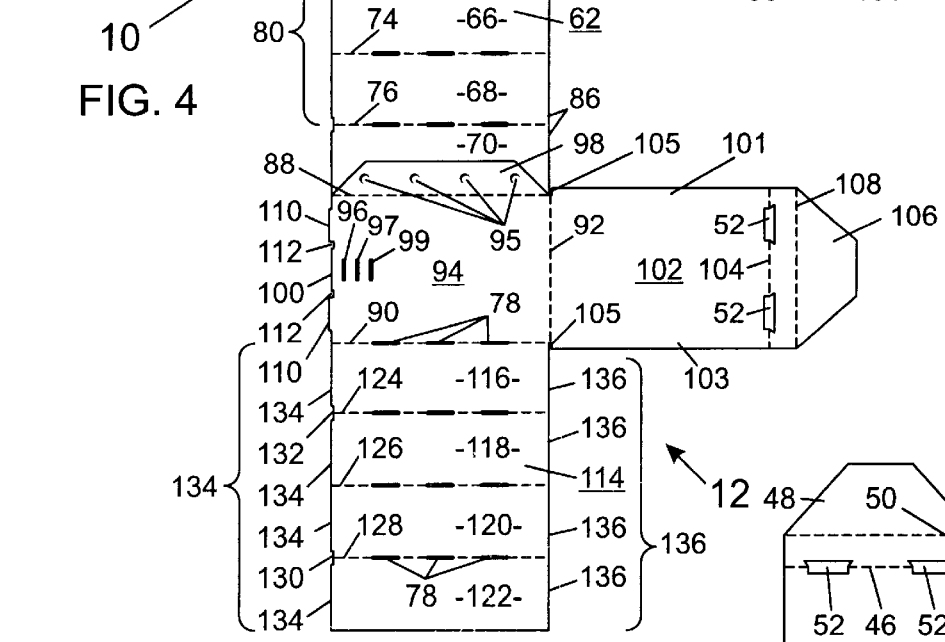

The upstanding load supporting panel 70 is shown in phantom in this instance to illustrate that all of the upstanding load supporting panels in each plurality of upstanding load supporting panels 62 and 114 connected to both sides of upstanding end panel 94 are slightly less in length than the length of upstanding end panel 94. Upstanding load supporting panel 70 will not actually or in fact be connected to upstanding load supporting panel 94 until blanks 10 and 12 are combined or connected together. FIGS. 4 and 11 both show upstanding load supporting panel 70 connected to flap 98 with the free end of upstanding load supporting panel 70 aligned or coinciding with fold line 88 and with the upper end wall 86 of upstanding load supporting panel 70 lying in the same plane as the upper end wall 136 of upstanding load supporting panel 116. In this position, it will be noted that the length of panel 70 is the same as the length of flap 98 and that the lower end wall 80 of the panel 70 lies in the same plane as the lower end wall 100 of upstanding end panel 94, all of which again very vividly illustrates that upstanding end panel 94 is slightly longer in length than the lengths of upstanding load supporting panels 70 and 116.

The longer length of end panel 94 changes the position of fold line 92 relative to the upper end wall 86 of the load supporting panel 70 and similarly changes the position of fold line 92 relative to the upper end wall 136 of the load supporting panel 116 or, as expressed in another manner, insures that the fold line 92 does not lie in the same horizontal plane as or in a straight line with upper end walls 86 and 136. So changing the position of fold line 92 insures that top panel 102 can be rotated about fold line 92 without striking or engaging a portion of the upper end walls 86 and 136 near fold line 92 and can thus be rotated about fold line 92 into coacting engagement with other panels of the seat or support without obstruction to or interference with such rotary movement.

In this particular instance, the length or height of upstanding end panel 94 exceeds the length or height of upstanding load supporting panels 70 and 116 by 3/32 of an inch or by slightly more than ½ of the thickness of the corrugated plastic sheet (2 millimeters). The slots 105—105 are also cut to remove 3/32 of an inch of material, as measured from fold line 92, from the ends of the overhang portions 101–103 so that the distance between the upper end walls 86 and 136 of the upstanding load supporting panels 70 and 134 and the end walls 57–59 of the overhang portions 51–53 created by the slots 105—105 is 3/16 of an inch (3/32 of an inch between end walls 86 and 136 and fold line 92 and 3/32 of an inch between the end walls 107 and 109 of overhangs portions 101–103 and the fold line 92). With the fold line 92 being so positioned, the top panel 92 can be rotated without obstruction around fold line 92 and can thereby seat flat on the upper end walls 86—86—86—86 and 136—136—136—136 of the first and second plurality of upstanding load supporting panels 62 and 114 and on the top end wall 60 of the first upstanding end panel 38 when all of the panels and auxiliary components are folded into an assembled and operable seat or support.

The first step in converting or transforming the two blanks 10 and 12 into an assembled and operable seat or support is to connect or combine the two blanks. As best shown in FIG. 4, one end of each of the blanks is rigidly connected or combined by connecting upstanding load supporting panel 70 of blank 10 to flap 98 on blank 12. With the end walls 80 and 134 and end walls 86 and 136 of the two blanks being aligned or extending in a straight line and with the free or outside end of panel 70 being aligned or coinciding with fold line 88 as shown in FIG. 4, the outside surface off flap 98 is then welded to the inside surface of panel 70 by sonic welding with the welding tool marks being shown in this instance by four small circles 95 on flap 98. The mating surfaces of panel 70 and flap 98 around the welding tool marks are fused together and thus are tightly secured to each other. When the two blanks 10 and 12 are folded into an assembled and operable seat or support, the inside surface of panel 70 will appear as being fused to the outside surface of flap 98.

When the panels are so connected by the panel 70 and flap 98 as shown in FIG. 4, the blank 12 is rotated or folded about fold line 88 and moved to the position shown in FIG. 5 wherein the inside surface of upstanding end panel 94 and the inside surface of the second plurality of upstanding load supporting panels 114 are moved or folded into engagement with the inside surfaces of the first plurality of upstanding load supporting panels 62 (underneath, not shown) and the inside surface of upstanding end panel 38 (underneath, not shown).

With the panels of the two blanks being so positioned, upstanding load supporting panel 122 is temporarily rotated upwardly around fold line 128 to expose a portion of upstanding end panel 38 and, in particular, the fold line 32 connecting upstanding end panel 38 to flap 42. The flap 42 on upstanding end panel 38 is then folded inwardly around fold line 32 into engagement with the inner surface of upstanding end panel 38. The upstanding load supporting panel 122 is then rotated downwardly around fold line 128 into engagement with the outside surface of flap 42 with the free end or end wall of upstanding end panel 122 being aligned or coinciding with fold line 32. The panel 122 is then welded to flap 42 (underneath, not shown) by sonic welding with the welding tool marks, in this instance, being shown in FIG. 5 by four small circles 95. As connected, the inside surface of panel 122 is rigidly or tightly secured to the outside surface of the flap 42 with the two mating surfaces around the welding tool marks being fused together.

It will be noted in FIG. 5 that, with both ends of the blanks being connected, the outside surfaces of the panels and components of blank 12 are shown, and the inside surfaces of the bottom panel 44 and the flap 48 of blank 10 are the only inside surfaces shown. The two blanks 10 and 12 and the panels thereof are now ready for further assembling into an assembled and operable seat or support.

The connected blanks 10 and 12 as shown in FIG. 5 are next rotated upwardly or to the right about end wall 136 and fold line 92 and about end wall 86 (underneath, not shown) into the position shown in FIG. 6 wherein the bottom portion or structure of the seat or support is facing upwardly with the first and second plurality of upstanding load supporting panels 62 and 114 standing upwardly and located or supported on a flat surface 138 such as a table top, a sidewalk or a road surface. In FIG. 6, it particularly will also be noted that the lower end walls 80—80—80—80 and 134—134—134—134 of the first and second plurality of upstanding load supporting panels 62 and 114 are facing upwardly and that the upper end walls 86—86—86—86 (not shown) and 136—136—136—136 (not shown) of the first and second plurality of upstanding load supporting panels 62 and 114 are supported or resting on the flat surface 138.

It will also be noted in FIG. 6 that bottom panel 44 is rotated or unfolded around fold line 36 and extends substantially normal to upstanding end panel 38 and that top panel 102 is rotated or unfolded around fold line 92 and extends substantially normal to upstanding end panel 94 and is positioned flat on flat surface 138 with the inside surface of the top panel 102 facing downwardly against the flat surface 138. It will further be noted in viewing FIG. 6 that the panels of the first and second plurality of upstanding load supporting panels 62 and 114 are bulging outwardly of upstanding end panels 38 and 94 and outwardly of top and bottom panels 102 and 44. The panels bulge outwardly due to the physical properties of the corrugated plastic of which the panels are made, and the panels being so positioned are obviously not positioned to support a load applied to the seat or support.

To effectively support a load, the panels of the first and second plurality of upstanding load support panels 62 and 114 must be connected or tied together in a certain configuration and must also be connected or tied to the two upstanding end panels 38 and 94. Being so connected, the first and second plurality of upstanding load supporting panels 62 and 114 must also be positioned or prepositioned between the two upstanding end panels 38 and 94 and between the top and bottom panels 102 and 44, and in particular must be positioned or prepositioned in a certain configuration within the width or dimensions of the two upstanding end panels 38 and 94 and within the width or dimensions of the top and bottom panels 102 and 44.

To further transform or convert the panels as shown in FIG. 6 into an assembled and operable seat or support, the panels of the first and second plurality of upstanding load supporting panels 62 and 114, with the bottom portion of the seat or support facing upwardly, must be connected or tied together in a partially folded triangular configuration, must be tied or connected to the two upstanding end panels 38 and 94, and must be positioned or prepositioned in a preselected position between end panels 38 and 94 and between top and bottom panels 102 and 44.

The two pluralities of upstanding load supporting panels 62 and 114 are so tied together, so connected to the two upstanding end panels 38 and 94, and are so positioned or prepositioned between the end panels 38 and 94 and the top and bottom panels 102 and 44 by means of connector means or connectors which in this preferred embodiment of the invention take the form of strap means or straps, one of which 140 is shown in FIGS. 12 and 13. The straps 140 are auxiliary components of the seat or support and each strap 140 is comprised of an elongated body portion 142 (rectangular in cross section) which at each end terminates in a head 144. A pin 146 having a pointed end 148 thereon is connected to one side of each head 144 and extends normal of the longitudinal axis of body portion 142. The strap 140 in this preferred embodiment of the invention is made of molded plastic and is thus a one-piece structure. The strap 140 has a preselected length as measured by the distance between the centerlines of the pins 146—146. All of the straps 140 utilized in this preferred embodiment of the invention are the same length.

The diameter of the pins is selected such that the pins 146—146 on each strap tightly fit in the longitudinally extending passageways 22 in the corrugated plastic, and the straps 140 thus hold the panels of the first and second plurality of upstanding load supporting panels 62 and 114 tightly together or in tight assembly, and similarly hold the panels of the first and second plurality of upstanding load supporting panels in tight assembly with the two upstanding end panels 38 and 94. Being so held by the straps 140, the first and second plurality of upstanding load supporting panels 62 and 114 are positioned or prepositioned between and within the width or dimensions of the two upstanding end panels 38 and 94 and within the width or dimensions of the top and bottom panels 102 and 44 to effectively support a load applied to the top panel 102 of the seat or support.

As seen in FIGS. 14, 15, 16, 17 and 22, the straps are installed or applied in preselected positions to connect the upstanding load support panels 62 and 114 to each other in a partially folded triangular configuration and to connect the first and second plurality of upstanding load supporting panels 62 and 114 to the upstanding end panels 38 and 94. As best shown in FIGS. 14, 15, 17 and 22, one strap 140 has the pin 146 on one end thereof positioned or received in the open end of one of the passageways 22 in one of the slots 54 in first upstanding end panel 38. The other pin 146 on the opposite end of the strap is positioned or received in the open end of one of the passageways 22 in the recess 84 in the lower end wall 80 of the first plurality of upstanding load supporting panels 62 at or near the intersection or the fold line 72 of upstanding load supporting panels 64 and 66, the recess 84 being dimensioned to extend in the two panels on both sides of fold line 78 (FIG. 1). Another strap 140 has the pin 146 on one end thereof similarly anchored in the second slot 54 in first upstanding end panel 38, and the pin 146 on the opposite end thereof anchored in one of the open ends of a passageway 22 in recess 130 in the bottom end wall 134 of the second plurality of upstanding load supporting panels 114 at or near the intersection or the fold line 128 of upstanding load supporting panels 120 and 122, the recess 130 also being dimensioned to extend in the two panels on both sides of fold line 128 (FIG. 2).

At the opposite end of the seat or support at upstanding end panel 94, one strap 140 has the pin 146 on one end thereof anchored in one of the open ends of one of the passageways 22 in one of the recesses 112 in the bottom end wall 100 of upstanding end panel 94. The pin 146 on the opposite end of the strap 140 in anchored in the open end of one of the passageways 22 in recess 82 in the lower end wall 80 of the first plurality of upstanding load supporting panels 62 at or near the intersection or the fold line 76 of upstanding load supporting panels 68 and 70, the recess 82 also being dimensioned to extend in the two panels on both sides of fold line 76 (FIG. 1).

Another strap 140 has the pin 146 on one end thereof anchored in the open end of one of the passageways 22 in the other recess 112 in the bottom end wall 100 of upstanding end panel 94. The pin 146 on the opposite end of the strap 140 is anchored in the open end of one of the passageways 122 in recess 132 in the bottom end wall 134 of the second plurality of upstanding load supporting panels 114 at or near the intersection or the fold line 124 of upstanding load supporting panels 116 and 118, the recess 132 also being dimensioned to extend in the two panels on both sides of fold line 124 (FIG. 2).

As best shown in FIGS. 17 and 22, another strap 140 connects panels 66 and 68 in the first plurality of upstanding load supporting panels 62, and the pins 146—146 on the ends of the strap 140 are received or anchored in the open ends of one of the passageways 22 in the lower end walls 80—80 of panels 66 and 68. Similarly, another strap 140 connects panels 118 and 120 in the second plurality of upstanding load supporting panels 114, and the pins 146—146 on the end of the strap 140 are received or anchored in the open ends of one of the passageways 22 in the lower end walls 134—134 of panels 118 and 120.

It will be noted in FIGS. 16 and 17 that all of the straps 140 when applied to the panels of the seat or support are stretched taught or extend in a straight line, whereas in FIGS. 14, 15, and 22 the straps have slack therein and thus do not extend in a straight line. The straps 140 are stretched taught or extend in a straight line only when the panels of the seat or support are finally assembled into an operable seat or support or, more particularly, when the top and bottom panels are rotated or folded into engagement with the two upstanding end panels and the flaps on the top and bottom panels are tightly secured to the upstanding end panels. The straps 140 and their function will be discussed in greater detail hereinafter.

FIG. 17 schematically shows the bottom structure of the assembled and operable seat or support and, particularly, illustrates the positions of all six of the straps 140 in a taught condition or extending in a straight line. It will be noted that two of the straps 140—140 each have one end anchored in the open end 22 (not shown) of a passageway (not shown) in slots 54—54 in upstanding end panel 38 and the opposite ends are anchored in one of the open ends 22 (not shown) of a passageway (not shown) in recesses 84 and 130 at or near the intersection or fold line 72 of upstanding load supporting panels 64 and 66 in the first plurality of upstanding load supporting panels 62 and at or near the intersection or fold line 128 of upstanding load supporting panels 120 and 122 in the second plurality of upstanding load supporting panels 114. It will be noted that the two straps 140—140 so anchored are arranged or positioned in an "X" formation or cross each other.

The slots 54—54 are located in upstanding end panel 38 on opposite sides of the longitudinally extending axis or centerline (not shown) of upstanding end panel 38, and the straps 140—140 each connect one-half or one side of upstanding end panel 38 as divided by the centerline thereof to the plurality of upstanding load supporting panels connected to the opposite side or the other half of the upstanding end panel 38. In this "X" formation, the straps 140—140 will exert a vectored force on the upstanding end panel 38 at slots 54—54 and on the first and second plurality of upstanding load supporting panels 62 and 114 at recesses 84 and 130. The components of the vectored forces will exert a force both longitudinally and transversely on the first and second plurality of upstanding load supporting panels 62 and 114 and, in particular, will move the panels of the first and second plurality of upstanding load supporting panels 62 and 114 inwardly into a position between and within the width or dimensions of the two upstanding end panels 38 and 94 and will also hold the first and second plurality of upstanding end panels 62 and 64 in tight assembly with upstanding end panel 38.

It will be similarly noted in viewing FIGS. 16 and 17 that two of the straps 140—140 each have one end anchored in the open end 22 (not shown) of a passageway (not shown) in recesses 112—112 in upstanding end panel 94 and the opposite ends are anchored in one of the open ends 22 (not shown) of one of the passageways (not shown) in recesses 82 and 132 at or near the intersection or the fold line 76 of upstanding load supporting panels 68 and 70 in the first plurality of upstanding end panels 62 and at or near the intersection or the fold line 124 of upstanding load supporting panels 116 and 118 in the second plurality of upstanding load supporting panels 114. It will also be noted that the two straps 140—140 being so anchored are arranged or positioned in an "X" formation or cross each other.

The recesses 112—112 are located in upstanding end panel 94 on opposite sides of the longitudinally extending axis or centerline (not shown) of upstanding end panel 94, and the straps 140—140 each connect one-half or one side of upstanding end panel 94 as divided by the center line thereof to the plurality of upstanding load supporting panels connected to the opposite side or the other half of upstanding end panel 94. In this "X" formation, the straps 140—140 will exert a vectored force on the upstanding end panel 94 at recesses 112—112 and on the first and second plurality of upstanding load supporting panels 62 and 114 at recesses 82 and 132. The components of the vectored forces will exert forces both longitudinally and transversely on the first and second plurality of upstanding load supporting panels 62 and 114 and, in particular, will move the panels of the first and second plurality of upstanding load supporting panels 62 and 114 inwardly into a position between and within the width or dimensions of the two upstanding end panels 38 and 94 and will also hold the first and second plurality of upstanding load supporting panels 62 and 114 in tight assembly with upstanding end panel 94.

Again referring to FIGS. 16 and 17, the two straps 140—140 connecting load supporting panels 66–68 and load supporting panels 118–120 prevent inward and outward bulging or transverse movement of the first and second plurality of upstanding load supporting panels 62 and 114. The two straps 140—140 also assist in holding the upstanding load supporting panels in tight assembly and connected to the upstanding end panels 38 and 94. The straps 140—140, furthermore, are essential to establishing and holding the upstanding load supporting panels in each plurality 62 and 14 in a partially folded triangular configuration with pairs of panels in each plurality intersecting each other and forming angles of intersection falling within a preselected range of degrees and with the end panels in each plurality of upstanding load supporting panels intersecting the two upstanding end panels and also forming angles of intersection falling within a preselected range of degrees.

With the panels in each triangular configuration in each plurality being so held and connected, the apexes of two of the triangles in each plurality of upstanding load supporting panels 62 and 114 extend inwardly or transversely of said upstanding end panels 38 and 94 and said top and bottom panels 102 and 44, and one apex of one of the triangles in each plurality of upstanding load supporting panels extends outwardly or transversely of said upstanding end panels and said top and bottom panels. When all of the panels and auxiliary components of the seat or support are folded and rigidly or tightly assembled into an assembled and operable seat or support, the first and second plurality of upstanding load supporting panels 62 and 114 being so held and assembled in a partially folded triangular configuration will then be positioned or prepositioned within and between the width or dimensions or the two upstanding end panels 38 and 94 and the top and bottom panels 102 and 44 and will thus provide load support that is distributed substantially evenly and effectively over the surfaces of the top and bottom panels and the two upstanding end panels.

In this preferred embodiment of the invention, the angles of intersection as illustrated in FIG. 17 are the following; Angle A is 43 degrees; Angle B is 91 degrees; Angle C is 89 degrees; Angle D is 94 degrees; Angle E is 46 degrees; Angle F is 44 degrees; Angle G is 93 degrees; Angle H is 92 degrees; Angle I is 91 degrees; and Angle J is 44 degrees. The angles of intersection between the end panels of the upstanding load supporting panels and the upstanding end panels 38 and 94 fall within a range of 43 degrees to 47 degrees, and the angles of intersection between the pairs of panels in each plurality of upstanding load supporting panels 62 and 114 fall within a range of 89 degrees to 94 degrees. A preselected range of 43 degrees to 48 degrees for the angles of intersection with the upstanding end panels will permit the upstanding load supporting panels to effectively carry or support a load applied to the seat or support. Similarly, the angles of intersection between pairs of panels in the upstanding load supporting panels falling within a preselected range of 85 to 95 degrees will permit the upstanding load supporting panels to effectively carry or support a load applied to the seat or support. All of the angles of intersection in this preferred embodiment to the invention fall within two preselected ranges of degrees.

It will be noted that the angles of intersection are not all equal in size or degrees. This difference in size results mainly from three factors. First, the flexibility of the COROPLAST® panels results in unequal bending of the panels. Second, the first and second plurality of upstanding load supporting panels 62 and 114 are not always welded or connected to the flaps 42 and 98 on the upstanding end panels 38 and 94 in precisely the same place on each flap. Third, the straps 140 are not all connected to the upstanding end panels 38 and 94 and to the end walls of the first and second plurality of the upstanding load supporting panels 62 and 114 in precisely the same place. The straps 140 are all the same length but are not all anchored in identical or equivalent positions in the slots and recesses in the upstanding end panels 38 and 94 and in the end walls of the first and second plurality of upstanding load supporting panels 62 and 114.

To further complete the application of the auxiliary components to the panels prior to the panels and auxiliary components being folded into an assembled and operable seat or support, quick-connect and disconnect fastening means or fasteners are next applied to the panels of the seat or support, and the fastening means or fasteners in this instance take the form of VELCRO® quick-connect and disconnect, two-part fasteners. The two-part fasteners are each comprised of a loop portion and a hook portion, and the two portions in the form of two VELCRO® strips have a preselected size and are applied to the panels in preselected positions. The loop strips and the hook strips are identical in size and both mate or correspond and coact with each other to hold the two strips tightly together and, at the same time, also hold the panels to which they are attached tightly together.

Eight of the VELCRO® strips are utilized in this preferred embodiment of the invention, four loop strips and four corresponding hook strips. As best seen in FIGS. 19 and 20, one loop portion in the form of a VELCRO® strip 149 is attached and positioned on the inside surface of flap 106 on top panel 102 near the free end or end wall of the flap 106. The loop strip 149 is adapted or positioned to mate or correspond with a VELCRO® hook strip 150 which is attached and positioned on the outside surface of upstanding end panel 38 in a preselected position. The VELCRO® strips 149 and 150 positioned on the flap 106 and the upstanding end panel 38 are tightly secured to the flap and the end panel by an adhesive (not shown) that performs satisfactorily when used on the COROPLAST® panels in combination with the VELCRO® strips, as will be discussed more in detail hereinafter.

As best seen in FIG. 22, another loop portion in the form of a VELCRO® strip 151 is attached and positioned on the inside surface of the flap 48 on bottom panel 44 near the free end of the flap 48. The loop strip 151 is adapted or positioned to mate or correspond with a VELCRO® hook strip 152 which is attached in a preselected position on the outside surface of upstanding end panel 94. The VELCRO® strips 151 and 152 positioned on the flap 48 and upstanding end panel 94 are also tightly secured to the flap and end panel by an adhesive (not shown) that performs satisfactorily when used on the COROPLAST® panels in combination with the VELCRO® strips, as will be discussed in more in detail hereinafter. VELCRO® strips 151 and 152 and their function will also be discussed more in detail hereinafter.

The loop and hook strips 149–150 and 151–152 will be moved into engagement with each other and will thus mate and coact in the final stage of assembly of the panels and auxiliary components into an assembled and operable seat or support, when the top and bottom panels are rotated into engagement with and are seated on the end walls of the first and second plurality of upstanding load supporting panels 62 and 114 and when the flaps 106 and 48 on the top and bottom panels 102 and 44 are tightly secured to the two upstanding end panels 38 and 94 by the loop and hook VELCRO® strips on the flaps and the upstanding end panels, as will also further be discussed hereinafter.

The other four VELCRO® strips are positioned on the flaps and upstanding end panels in different positions or locations to enable the assembled and operable seat or support to be unfolded and thereafter refolded in a certain manner or sequence for a quick conversion into a tightly secured and self-contained compact bundle or package. As best seen in FIGS. 18 and 22, a VELCRO® loop strip 153 is positioned and attached on the outside surface of flap 106 on top panels 102 near the free end of the flap. A corresponding VELCRO® hook strip 154 is attached to the inside surface of the bottom panel 44 in a preselected position, and the two strips 153 and 154 are adapted to mate and coact. The two VELCRO® strips 153 and 154 are also attached to the flap 106 and the bottom panel 44 by an adhesive as hereinbefore mentioned.

As best seen in FIGS. 16 and 19, a VELCRO® loop strip 155 (FIG. 16) is positioned and attached on the outside surface of flap 48 on bottom panel 44 near the free end of the flap. A corresponding VELCRO® hook strip 156 (FIG. 19) is attached to the inside surface of top panel 102 in a preselected position, and the two strips 155 and 156 are adapted to mate and coact. The two strips 155 and 156 are attached to the flap 48 and the top panel 102 by an adhesive as hereinbefore mentioned.

The two pairs of loop and hook strips 153–154 and 155–156 will be moved into engagement with each other and will thus mate and coact when the assembled and operable seat or support is unfolded and thereafter refolded in a certain manner or sequence for a quick conversion into a tightly secured and self-contained compact bundle or package. The conversion of the assembled and operable seat or support into a tightly secured and self-contained compact bundle or package will also be discussed in detail hereinafter.

As best seen in FIGS. 22 and 23, another auxiliary component in the form of a shoulder strap or carrying strap 158 is attached to the seat or support but the strap is only used as a shoulder or carrying strap after the seat or support is converted into a tightly secured and self-contained compact bundle or package. FIG. 27 shows the completed or assembled and operable, tightly secured and self-contained compact bundle or package 160 as having a shoulder strap 158 forming an integral part thereof. The strap 158 has a preselected length and width and is made of any suitable material. The ends of the strap 158 are attached to the two upstanding end panels.

Referring to FIG. 1 and blank 10, upstanding end panel 38 includes three elongated slots 40, 41 and 43 therein in the bottom portion of the panel. The slots 40, 41 and 43 each have a preselected length and width, are identical in size, and are positioned a preselected distance apart. The three slots are also centered in the bottom portion of upstanding end panel 38 and the slot 40 is spaced a preselected distance from fold line 36. Referring to FIG. 2 and blank 12, upstanding end panel 94 also includes three elongated slots 96, 97 and 99 therein, and the three slots are also centered in the bottom portion of the upstanding end panel 94. The three slots 96, 97 and 99 each have a preselected length and width, are identical in size, and are positioned a preselected distance apart. The bottom slot 96 is spaced a preselected distance from the lower end wall 100 of upstanding end panel 94.

The strap 158 is fastened or attached to the upstanding end panels 38 and 94 by threading the ends of the strap into and through the slots 40-41-43 and 96-97-99 in a certain manner or sequence so as to anchor the ends of the straps in the three slots in each end panel 38 and 94.

In this instance, the ends of the straps are attached to the end panels by first moving the unassembled seat or support to the position on a flat surface 138 as shown in FIGS. 14 and 22 with the bottom structure of the seat or support facing upwardly. The three slots in the bottom portion of the end panels 38 and 94 will then be positioned near the fold line 36 (FIG. 22) connecting upstanding end panel 38 and bottom panel 44, and near to bottom wall 100 (FIGS. 14 and 22) of upstanding end panel 94. Being so positioned, the slots are now easily accessible for threading the ends of the strap 158 into and through the slots.

Referring to FIGS. 2, 11, 14 and 22, one end of strap 158 will be threaded into and anchored in slots 96-97-99 in upstanding end panel 94. The position of the three slots in upstanding end panel 94 prior to the final assembly of the seat or support is best shown in FIGS. 14 and 22 with the bottom portion of the structure facing upwardly. With the upstanding end panel 94 and the slots 96-97-99 therein in this position, one end of the strap 158 is first threaded through slot 96, the slot 96 being the slot nearest the bottom wall 100 of upstanding end panel 94. The strap 158 is threaded into slot 96 from the inside surface of upstanding end panel 94.

From slot 96, the strap 158 is next moved along the outside surface of upstanding end panel 94 and then inserted into slot 99. The strap 158 is then pulled through slot 99 and moved along the inside surface of the upstanding end panel 94. The strap is then again inserted into slot 96 from the inside surface of upstanding end panel 94 and threaded underneath the portion of the strap already threaded through slot 96. The end of the strap 158 is then pulled through slot 96 and moved along the outside surface of upstanding end panel 94.

The end of the strap 158 is then inserted into the middle slot 97 from the outside surface of the upstanding end panel 94 and a short length of the strap is pulled through the slot 97 and positioned on or along the inside surface of the upstanding end panel 94. The end of the strap 158 will now be positioned between the inside surface of upstanding end panel 94 and the inside surface of the loop of the strap 158 extending between slots 96 and 99.

With the end of the strap 158 now being positioned a short distance from the inside surface of upstanding end panel 94, a portion of the strap remote from the upstanding end panel 94 is then pulled so as to tighten the portion of the strap 158 in the slots. The end of the strap will now be tightly anchored in the three slots 96-97-99 and will thus be anchored to the upstanding end panel 94. Being so anchored, the strap 158 will be positioned along the inside surface of the upstanding end panel 94 and will also be positioned within the "X" formation of the connectors or straps 140—140. With the strap 158 so positioned, the strap 158 will not move longitudinally of the seat or support and will not interfere with or abut the crossed straps 140—140 when the strap 158 is used as a shoulder strap to support or carry the tightly secured and self contained compact bundle or package.

The other end of the strap 158 will be correspondingly threaded through and anchored in the three slots 40-41-43 in upstanding end panel 38. The sequence of the threading and the resultant strap structure is identical to that employed in connection with upstanding end panel 94 and, for the sake of brevity, will not be repeated.

To complete the assembly of the panels and auxiliary components into an assembled and operable seat or support after all of the auxiliary components are applied, the panels and auxiliary components are first moved into the position shown in FIG. 22 on flat surface 28. The shoulder strap 158 is then placed in the enclosure formed by the upstanding end panels 38 and 94 in combination with the first and second plurality of upstanding load supporting panels 62 and 114.

The bottom panel 44 is then rotated around fold line 36 toward upstanding end panel 94 until the inside surface of the bottom panel 94 near slots 52—52 abut the free ends of the tabs 110—110. Force is then applied to the two upstanding end panels 94 and 38 to move them farther apart a short distance until the two tabs 110—110 are received in slots 52—52 and are seated in the rectangular portion of the slots. The tabs are dimensioned to be snugly received in the rectangular portions of the slots 52—52 and the trapezoidal portion of the slots 52—52 function as a guide to direct the tabs 110—110 into the rectangular portions of the slots 52—52. When the tabs 110—110 are so positioned or seated, the two upstanding end panels 94 and 38 will be held a preselected distance apart by bottom panel 44 and the straps 140 will then be extended in a straight line or the slack therein will be removed.

The inner surface of bottom panel 44 will now be seated on the lower end walls 80—80—80—80 and 134—134—134—134 of the first and second plurality of upstanding load supporting panels 62 and 114, and the portions of the bottom panel 44 near fold line 46 and between and on both sides of the slots 52—52(FIG. 11) will seat on the three bottom end wall portions 100—100—100 (FIGS. 11, 14 and 22) of upstanding end panel 94.

The flap 98 is then rotated around fold line 46 until loop VELCRO® strip 151 on the inside surface of flap 48 is moved into engagement with hook VELCRO® strip 152 on upstanding end panel 94. The two strips 151–152 will then coact and hold the flap 48 on bottom panel 44 in tight engagement with the upstanding end panel 94 and, as a result, will hold all of the panels and auxiliary components in the bottom structure of the seat or support in tight engagement.

To finally complete the assembly of the panels and auxiliary components into an assembled and operable seat or support after the seat or support is partially assembled as just described with the bottom panel 44 tightly attached to upstanding end panel 94 by the flap 48 and VELCRO® strips 150–151, the partially assembled seat or support is then moved to the position shown in FIG. 20 with the bottom panel 44 resting on flat surface 138 and top panel 102 unfolded to illustrate the construction of the top portion of the seat or support. It will be noted that shoulder strap 158 is not yet shown as being threaded in and through the slots 40-41-43 in FIG. 20.

The top panel 102 is then rotated around fold line 92 toward upstanding end panel 38 until the inside surface of the top panel 102 near slots 52—52 abut the free ends of the tabs 56—56. Force is then applied to the two upstanding end panels 38 and 94 to move them apart a short distance until the two tabs 56—56 are received in slots 52—52 and are seated in the rectangular portions of the slots (FIGS. 18 and 21). The tabs 56—56 are dimensioned to be snugly received in the rectangular portions of the slots 52—52, and the trapezoidal portions of the slots 52—52 function as guides to direct the tabs 56—56 into the rectangular portions of the slots 52—52. When the tabs 56—56 are so positioned or seated, the two upstanding end panels 38 and 94 will be held a preselected distance apart by the top panel 102 and the straps 140 will be extended in a straight line or the slack therein will be removed. When the tabs 56—56 are so positioned or seated, an additional force will also be applied to the straps 140 and will assist in extending the straps 140 in a straight line or removing the slack therefrom.

Now referring to FIGS. 18, 19, 20 and 21, the inner surface of top panel 102 will now be seated on the upper end walls 86—86—86—86 and 136—136—136—136 of the first and second plurality of upstanding load supporting panels 62 and 114, and the portions of the top panel 102 near fold line 104 between and on both sides of slots 52—52 (FIG. 10) will seat on the three bottom end wall portion 60—60—60—60 (FIG. 10) of upstanding end panel 38.

As best seen in FIG. 20, the flap 106 is then rotated around fold line 92 until loop VELCRO® ) strip 149 on the inside surface of flap 106 is moved into engagement with hook VELCRO® strip 150 on upstanding end panel 138. The two strips 149–150 will then coact and hold the flap 106 on top panel 102 in tight engagement with the upstanding end panel 38 and, as a result, will hold all of the panels and auxiliary components in the top portion of the seat or support in tight engagement.

When the top and bottom panels 102 and 44 are so positioned and tightly connected, all of the panels and auxiliary components are tightly connected and the first and second plurality of upstanding load supporting panels 62 and 114 will be positioned or prepositioned in a partially folded triangular configuration between and within the width or dimensions of the two upstanding end panels 38 and 94 and between and within the width or dimensions of the top and bottom panels 102 and 44. The seat or support as now assembled is capable of supporting a load and the load will be effectively distributed and applied to the upstanding end panels 38 and 94 on or through end wall portions 60—60—60 and 100—100—100, respectively, and will also be applied to the upper and lower end walls 86—86—86—86 and 136—136—136—136 and 80—80—80—80 and 134—134—134 of the first and second plurality of upstanding load supporting panels 62 and 114.

The assembled and operable seat or support 11 is shown in FIG. 18 with top panel 102 facing upwardly and with the bottom panel 44 seated on the flat surface 138. The shoulder strap 158 is not shown in FIG. 18 as applied to the seat or support. The assembled seat or support 11 is also shown in FIG. 16 with the bottom panel 44 facing upwardly and with the top panel 102 seated on the flat surface 138. The bottom panel 44 is shown as mostly cut away to illustrate that the six straps 144 are stretched taught when the seat or support is fully assembled and operable.

The assembled and operable seat or support 11 can now be unfolded and thereafter refolded in a certain manner or sequence for a quick conversion into a tightly secured and self contained compact bundle or package for carrying, for use as a seat cushion, or for storage. The bundle or package is shown in FIGS. 25, 26 and 27 and is designated by the reference numeral 160. FIGS. 25 and 26 show the bundle or package as being partially completed with the top and bottom panels 102 and 44 and the flaps 106 and 48 thereon being shown in the positions occupied just prior to and after the final assembly of the bundle or package. FIG. 27 shows the fully assembled and operable bundle or package 160 ready for carrying or storage with the shoulder strap 158 attached or for use as a seat cushion.

To convert the assembled and operable seat or support 11 into a tightly secured and self-contained compact bundle or package, flaps 48 and 106 are first released from upstanding end panels 94 and 38 and the unfolded structure is then moved into the position as shown in FIG. 22 with the bottom portion of the seat or support facing upwardly and with the loop portion of the strap 158 being placed or positioned on the outside of the seat or support.

The unfolded structure as shown in FIG. 22 is then partially compressed (by hand) into the position shown in FIG. 23 with the first and second pluralities of upstanding load supporting panels 62 and 114 being compressed against or between the two upstanding end panels 94 and 38. FIG. 24 shows the positions occupied by the individual upstanding load supporting panels and the pairs of upstanding load supporting panels of the first and second plurality of upstanding load supporting panels 62 and 114, as the panels are being compressed and illustrates, in particular, that the inner ends of the individual load supporting panels at the apexes of the triangles formed by the folded pairs of panels will not strike or abut each other and that the upstanding load supporting panels will be folded flat between the upstanding end panels 94 and 38 when fully compressed.

The structure as shown in FIG. 23 is then rotated downwardly or around fold line 92 until the outside surface of upstanding end panel 94 is moved flat into engagement with the outside surface of top panel 102. When moved into this position, the inner surface of panel 102 will still be located or positioned on flat surface 138 and the outside surface of bottom panel 44 will be folded around fold line 36 into engagement with the outside surface of upstanding end panel 38. The formerly inside surfaces of the bottom and top panels 102 and 44 now become the outside surfaces of the structure and the VELCRO® strips on the formerly outside surfaces of the flaps 106 and 48 now become positioned on the inside surfaces of the flaps 106 and 48. Similarly, the VELCOR® strips on the formerly inside surfaces of upstanding end panels 38 and 94 now become positioned on the outside surfaces of upstanding end panels 38 and 94. The top and bottom panels 102 and 44 have thus been reversely rotated into engagement with the upstanding end panels with the formerly inside surfaces of the top and bottom panels now becoming the outsides surfaces thereof. As seen in FIG. 22, VELCRO® strip 153 positioned on the formerly inside surface of flap 106 is now adapted and positioned to mate with VELCRO® strip 154 positioned on the formerly inside surface of bottom panel 44. Similarly, VELCRO® strip 155 on the formerly outside surface of flap 48 (FIG. 16) is now positioned on the inside surface of flap 48 and is now positioned to mate with VELCRO® strip 156 (FIG. 19) formerly positioned on the inside and now the outside surface of top panel 102.

FIG. 25 show the structure as shown in FIG. 23 after all of the panels and auxiliary components as shown in FIG. 23 are rotated around fold line 92, and the outside surface of upstanding end panel 94 is moved into engagement or laid on the outside surface of top panel 102. The outside surface of bottom panel 44 will also have been rotated or moved around fold line 36 and moved into engagement with the outside surface of upstanding end panel 38. FIG. 25 shows this structural arrangement after the rotation of the panels with the formerly inside and now outside surface of bottom panel 44 facing upwardly and with the formerly outside and now inside surface of panel 102 facing inwardly and upwardly. It will also be noted that the formerly outside and now inside surface of flap 106 on top panel 102 faces upwardly and that the VELCRO® strip 153 is attached thereto.

To partially complete the assembly of the tightly secured and compact bundle 160, flap 106 is first rotated around fold line 104 and then again around fold line 108 (FIGS. 25 and 27) until the VELCRO® strip 153 mates and coacts with VELCRO® strip 154 (not shown in FIG. 25 but shown in FIG. 22) on bottom panel 44 to tightly connect bottom panel 44 and flap 106. With the flap 106 having two fold lines 104 and 108 therein, the preselected distance between the two fold lines will result in the flap 106, as it is rotated around fold line 108, compressing the end of the package of panels so that all of the panels will be held in a tight and self-contained bundle or package. It will be noted that the loop and the strap 158 is positioned to be moved laterally of the flap 106 or enlarged so that the flap 106 can be rotated inside the loop of the strap and the VELCRO® strip 153 can be moved into engagement with and mate with VELCRO® strip 154 on bottom panel 44 (underneath the flap and not shown) to hold the flap 106 in tight engagement with bottom panel 44.

FIG. 26 shows the partially completed structure of FIG. 25 rotated 180 degrees around the longitudinal axis of the partially completed structure. Top panel 102 is now facing upwardly and bottom panel 44 is now positioned on the flat surface 138. To complete the assembly of the tightly secured and compact bundle or package, flap 48 is then rotated about fold lines 46 and 50 until VELCRO® strip 155 on the flap mates and coacts with VELCRO® strip 156 (underneath flap and not shown) on top panel 102. The flap 48 being tightly secured to top panel 102 will now hold and tightly compress all of the panels so that both ends of the bundle or package are tightly compressed and held in assembly. It will be noted that the strap 158 is now extending from both sides of the tightly secured and self contained compact bundle or package. The tightly contained bundle or package now assumes the configuration as shown in FIG. 27 and is fully ready to be carried by the shoulder strap, to be stored, or to be used as a seat cushion.

FIG. 28 shows a single blank that can be used instead of two blanks to construct or form the assembled and operable seat or support of the present invention. The single blank is identical in structure and size to the double blank version with the exception that the single blank does not include a flap 98 thereon integrally connected to one side of end panel 94, whereby the two blanks 10 and 12 can be connected together as shown in FIG. 4. Instead, upstanding load supporting panel 70 is integrally connected to upstanding end panel 94 along fold line 88 to form a single-blank or one piece construction.

In this preferred embodiment of the invention, the dimensions of the blanks, panels and auxiliary components as well as the overall dimensions of the assembled and operable seat or support together with the overall dimensions of the tightly secured, compact bundle or package are set forth below. The structure of the auxiliary components and the positions thereof as well as materials or adhesives utilized or any other pertinent information relating to the structure or function of the seat or support, to the extent not already herein mentioned, will also be set forth below.

Referring to FIG. 1 and blank 10, one of the overall dimensions of blank 10 from the end wall or free end of flap 48 to the end walls or free ends of tabs 56—56 is thirty eight and five-eighths inches (38⅝"). The other overall dimension of blank 10 from the end wall or free end of flap 42 to the end wall or free end of upstanding load supporting panel 70 is thirty four and one-half inches (34½").

Referring to FIG. 2 and blank 12, one of the overall dimensions of blank 12 from the end wall or free end of flap 106 to the end walls or free ends of tabs 110—110 is thirty-eight and five-eighths inches (38⅝"). The other overall dimension of blank 12 from the end wall or free end of flap 98 to the end wall or free end of upstanding load supporting panel 114 is thirty-four and one-half inches (34½").

Referring to FIG. 28, single blank 13 has an overall dimension of sixty-six and one-half inches (66½") as measured from the end wall or free end of flap 42 to the end wall or free end of upstanding load supporting panel 122. The other overall dimension of blank 13 is sixty and seven-eighths inches (60⅞"). This measurement is derived by adding the dimension between the free end of flap 48 and end wall 60, thirty eight and seven sixteenths inches (38⁷⁄₁₆"), to the dimension between the end wall or free end of flap 106 and the plane in which the top end walls 86—86—86—86 and 136—136—136—136 of the first and second plurality of upstanding load supporting panels 62 and 114 are positioned or situated, twenty two and seven sixteenths inches (22⁷⁄₁₆"), for a total dimension of sixty and seven-eighths inches (60⅞"). All of the other dimensions are identical to those of the two separate blanks 10 and 12 as shown in FIGS. 1 and 2, respectively.

Referring to FIGS. 1 and 10, upstanding end panel 38 measures sixteen and three-thirty-seconds inches (16³⁄₃₂") in length between fold line 36 and end wall 60, and is eleven inches (11") wide as measured between fold lines 32 and 34. The trapezoidal-shaped flap 42 on upstanding end panel 38 measures, in width, one and one-half inches (1½") between fold line 32 and the parallel free end of flap 42. The base of flap 42 (fold line 32) measures sixteen inches (16") in length between fold line 36 and end wall 60. The shorter parallel free end of flap 42 measures fifteen inches (15") between the converging sides of the trapezoidal-shaped flap 42. The converging sides of flap 42 are equal in length and each measures one and nine-sixteenths inches (1⁹⁄₁₆").

The elongated slots 40-41-43 in upstanding end panel 38 are each one and three-sixteenths inches (1³⁄₁₆") long and one-eighth inch (⅛") wide. The three slots are spaced seven-eighths inches (⅞") apart as measured from the longitudinal axis or centerline (not shown) of each slot. Slot 40 is one inch (1") from fold line 36 as measured from the longitudinal axis or centerline of the slot. Slots 40-41-43 are bisected by the longitudinal axis or centerline (not shown) extending through flap 48, bottom panel 44 and upstanding end panel 38.

The two slots 54—54 are each five-eighths inches (⅝") square. The slots 54—54 are bisected by fold line 36 and thus are positioned in the upstanding panel 38 and bottom panel 44 on both sides of fold line 36. Slots 54—54 are spaced three and five-eighths inches (3⅝") apart as measured from the center of each slot. One slot 54 is positioned three and eleven-sixteenths inches (3¹¹⁄₁₆") from fold line 32 as measured from the center of the slot to the fold line. The other slot 54 is positioned three and eleven-sixteenths inches (3¹¹⁄₁₆") from fold line 34 as measured from the center of the slot to the fold line.

Tabs 56—56 on top end wall 60 of the upstanding end panel 38 are each two and one-half inches (2½") long. The tabs 56—56 each protrude or extend three-sixteenths inches (³⁄₁₆") from top end wall 60. The inner ends or inner end walls of tabs 56—56 are spaced four inches (4") apart along the top end wall 60 of upstanding end panel 38. This four inch (4") length of top end wall 60 provides load support for top panel 102 when the top panel 102 is rotated into engagement with top end wall 60 and the flap 106 on top panel 102 is tightly secured to the outside surface of upstanding end panel 38. The outer ends or end walls of tabs 56—56 are each spaced one inch (1") from fold lines 32 and 34. These one inch (1") lengths along top end wall 60 provide additional load support for top panel 102 when top panel 102 is rotated into engagement with top end wall 60 and flap 106 on top panel 102 is tightly secured to the outside surface of upstanding end panel 38.

Again referring to FIGS. 1 and 10, the bottom panel 44 is foldably connected to upstanding end panel 38 along fold line 36. The bottom panel 44 is twelve inches (12") wide as measured from the free side or outside wall of overhang 51 to the free side or outside wall of overhang 53. Bottom panel 44 is sixteen and three-thirty-seconds inches (16³⁄₃₂") long as measured between fold line 36 and fold line 46. Bottom panel 44 and upstanding end panel 38 are thus both the same length and each panel is sixteen and three thirty-seconds inches (16³⁄₃₂") long.

Flap 48 on bottom panel 44 is six and one-quarter inches (6¼") long as measured from fold line 46 to the parallel free end of flap 48. Flap 48 is twelve inches (12") wide as measured from the free side or outside wall of overhang 51 to the free side or outside wall of overhang 53. Flap 48 is divided by fold line 50 into two parts, a rectangular-shaped part and a trapezoidal-shaped part. The rectangular-shaped part is twelve inches (12") long as measured from the free side or outside wall of overhang 51 to the free side or outside wall of overhang 53. The rectangular-shaped part is two inches (2") wide as measured from fold line 46 to fold line 50.

The trapezoidal-shaped part of flap 48 is twelve inches (12") wide at it's base formed by fold line 50 as measured from the free side or outside wall of overhang 51 to the free side or outside wall of overhang 53. The height of the trapezoidal-shaped part is four and one-quarter inches (4¼") as measured from the base (fold line 50) to the parallel free end of flap 48. The free end of flap 48 is three inches (3") long as measured between the ends of the converging sides of the trapezoidal-shaped part. The converging sides of the trapezoidal-shaped part of flap 48 are equal in length and each measures five and one-half inches (5½") long.

Referring to FIGS. 1 and 7, the two irregularly-shaped slots 52—52 are cut or formed in both the bottom panel 44 and the flap 48. The rectangular parts of the slots 52—52 (FIG. 7) adjacent to fold line 46 in bottom panel 44 are two and one-half inches (2½") long as measured along fold line 46 and are three-sixteenths inches (³⁄₁₆") wide or deep. The inside ends of the rectangular parts of slots 52—52 are spaced four inches (4") apart as measured along fold line 46. The distance between the outside end of the rectangular part of one slot 52 along fold line 46 and the free end or outside wall of overhang 51 measures one and one-half inches (1½"). The distance between the outside end of the rectangular part of the other slot 52 along fold line 46 and the free end or outside wall of overhang 53 also measures one and one-half inches (1½").

The height of the trapezoidal portion of each slot 52 is one-half inch (½") as measured between fold line 46 and the parallel end or end wall of each slot 52 in flap 48. The longer of the two parallel sides of the trapezoidal portion of each slot 52 is two and seven-eighths inches (2⅞") long as measured between the ends of the diverging sides of the trapezoidal portion of each slot 52. The shorter of the two parallel sides of the trapezoidal portion of each slot 52 is two and one-half inches (2½") long as measured along fold line 46 between the ends of the converging sides of the trapezoidal portion of each slot. The two converging sides of the trapezoidal portion of each slot 52 are equal in length and each measures seventeen thirty-seconds inches (¹⁷⁄₃₂") long.

Referring again to FIG. 1, upstanding load supporting panel 64 connected to upstanding end panel 38 along fold line 34 is five and one-half inches (5½") wide as measured between fold line 34 and fold line 72. Upstanding load supporting panel 66 is five and one-half (5½") inches wide as measured between fold line 72 and fold line 74. Upstanding load supporting panel 68 is five and one-half inches (5½") wide as measured between fold line 74 and fold line 76. Upstanding load supporting panel 70 is five and one-half inches (5½") wide as measured between fold line 76 and the parallel free end or side of upstanding load supporting panel 70. All four of the upstanding load supporting panels 64, 66, 68 and 70 in the first plurality of upstanding load supporting panels 62 are each sixteen inches (16") long as measured between lower end walls 80—80—80—80 and upper end walls 86—86—86—86.

Recess 84 in lower end wall 80 is one inch (1") long and is bisected by fold line 72. Recess 84 is three-sixteenths inches (3/16") deep in end wall 80. Recess 82 in lower end wall 80 is also one inch (1") long and is bisected by fold line 76. Recess 82 is also three-sixteenths inches (3/16") deep in end wall 80.

The elongated slots 78 utilized to form fold lines between the four upstanding load supporting panels 64, 66, 68 and 70 are each two inches (2") long and one-eighth inches (⅛") wide. There are three slots 78 on each fold line 34, 72, 74, and 76 comprising a total of twelve slots 78 in blank 10. The four slots 78 nearest the upper end wall 86 are each positioned three inches (3") from upper end wall 86 as measured from the outside ends of the four slots 78 to end wall 86 along the fold lines 34, 72, 74 and 76. The four slots 78 nearest the lower end wall 80 are each positioned three inches (3") from lower end wall 80 as measured from the outside ends of the four slots to the end wall 80 along fold lines 34, 72, 74 and 76. The four slots intermediate or in between the eight other slots are each positioned seven inches (7") from upper end wall 86 and seven inches (7") from lower end wall 80 as measured from the ends of the four slots 78 along fold lines 34, 72, 74 and 76.

Referring now to FIGS. 2 and 11, upstanding end panel 94 measures sixteen and three-thirty-seconds inches (16 3/32") in length between fold line 92 and end wall 100, and is eleven inches (11") wide as measured between fold lines 88 and 90. The trapezoidal-shaped flap 98 on upstanding end panel 94 measures one and one-half inches (1½") in width between fold line 88 and the parallel free end of flap 98. The base of flap 98 (fold line 88) measures sixteen inches (16") in length between fold line 92 and end wall 100. The shorter parallel free end of flap 98 measures fifteen inches (15") between the converging sides of the trapezoidal-shaped flap 98. The converging sides of flap 98 are equal in length and each measures one and nine-sixteenths inches (1 9/16") long.

The elongated slots 96-97-99 in upstanding end panel 94 are each one and three-sixteenths inches (1 3/16") long and one-eighth inch (⅛") wide. The three slots are spaced seven-eighths inches (⅞") apart as measured from the longitudinal axis or centerline (not shown) of each slot. Slot 96 is one inch (1") from fold line 92 as measured from the longitudinal axis or centerline of the slot. Slots 96-97-99 are bisected by the longitudinal axis or centerline (not shown) extending through flap 106, top panel 102 and upstanding end panel 94.

Tabs 110—110 on bottom end wall 100 of the upstanding end panel 94 are each two and one-half inches (2½") long. The tabs 110—110 each protrude or extend three-sixteenths inches (3/16") from bottom end wall 100. The inner ends or inner end walls of tabs 110—110 are spaced four inches (4") apart along bottom end wall 100 on upstanding end panel 94. This four inch (4") length of bottom end wall 100 provides load support for bottom panel 44 when the bottom panel 44 is rotated into engagement with bottom end wall 100 and the flap 48 on bottom panel 44 is tightly secured to the outside surface of upstanding end panel 94. The outer ends or end wall of tabs 110—110 are spaced one inch (1") from fold lines 88 and 90. These one inch (1") lengths along bottom end wall 100 provide additional load support for bottom panel 44 when bottom panel 44 is rotated into engagement with bottom end wall 100 and flap 48 on bottom panel 44 is tightly secured to the outside surface of upstanding end panel 94.

Referring to FIG. 11, recesses 112—112 along bottom end wall 100 are each one-eighth inch (⅛") deep as measured from the bottom end wall 100. Recesses 112—112 along bottom end wall 100 are each one-half inch (½") long as measured from the inner end walls of tabs 110—110 to the parallel one-eighth inch (⅛") long end wall of each recess 112-112.

Top panel 102 is foldably connected to upstanding end panel 94 along fold line 92. The top panel 102 is twelve inches (12") wide as measured from the free side or outside wall of overhang 101 to the free side or outside wall of overhang 103. Top panel 102 is sixteen and three-thirty-seconds inches (16 3/32") long as measured between fold line 92 and fold line 104.

Flap 106 on top panel 102 is six and one-quarter inches (6¼") long as measured from fold line 104 to the parallel free end of flap 106. Flap 106 is twelve inches (12") wide as measured from the free side or outside wall of overhang 101 to the free side or outside wall of overhang 103. Flap 106 is divided by fold line 108 into two parts, a rectangular-shaped part and a trapezoidal-shaped part. The rectangular-shaped part is twelve inches (12") long as measured from the free side or outside wall of overhang 101 to the free side or outside wall of overhang 103. The rectangular-shaped part is two inches (2") wide as measured from fold line 104 to fold line 108.

The trapezoidal-shaped part of flap 106 is twelve inches (12") wide at it's base formed by fold line 108 as measured from the free side or outside wall of overhang 101 to the free side or outside wall of overhang 103. The height of the trapezoidal-shaped part is four and one-quarter inches (4¼") as measured from the base (fold line 108) to the parallel free end of flap 106. The free end of flap 106 is three inches (3") long as measured between the ends of the converging sides of the trapezoidal-shaped part. The converging sides of the trapezoidal-shaped part of flap 106 are equal in length and each measures five and one-half inches (5½") long.

Referring now to FIGS. 2 and 7, the two irregularly-shaped slots 52—52 are cut or formed in both the top panel 102 and the flap 106. The rectangular parts of the slots 52—52 (FIG. 7) adjacent to fold line 104 in top panel 102 are two and one-half inches (2½") long as measured along fold line 104 and are three-sixteenths inches (3/16") wide or deep. The inside ends of the rectangular parts of slots 52—52 are spaced four inches (4") apart as measured along fold line 104. The distance between the outside end of the rectangular part of one slot 52 along fold line 104 and the free end or outside wall of overhang 101 measures one and one-half inches (1½"). The distance between the outside end of the rectangular part of the other slot 52 along fold line 104 and the free end or outside wall of overhang 103 also measures one and one-half inches (1½").

The height of the trapezoidal portion of each slot 52 is one-half inch (½") as measured between fold line 104 and the parallel end or end wall of each slot 52 in flap 106. The longer of the two parallel sides of the trapezoidal portion of each slot 52 is two and seven-eighths inches (2⅞") long as measured between the ends of the diverging sides of the trapezoidal portion of each slot 52. The shorter of the two parallel sides of the trapezoidal portion of each slot 52 is two and one-half inches (2½") long as measured along fold line 104 between the ends of the converging sides of the trapezoidal portion of each slot. The two converging sides of the trapezoidal portion of each slot 52 are equal in length and each measures seventeen thirty-seconds inches (17/32") long.

Referring to FIG. 2, upstanding load supporting panel 116 connected to upstanding load support panel 94 along fold line 90 is five and one-half inches (5½") wide as measured between fold line 90 and fold line 124. Upstanding load supporting panel 118 is five and one-half inches (5½") wide as measured between fold line 124 and fold line 126. Upstanding load supporting panel 120 is five and one-half inches (5½") wide as measured between fold line 126 and fold line 128. Upstanding load supporting panel 122 is five and one-half inches (5½") wide as measured between fold line 128 and the parallel free end or side of upstanding load supporting panel 122. All four of the upstanding load supporting panels 116, 118, 120 and 122 in the second plurality of upstanding load supporting panels 114 are each sixteen inches (16") long as measured between upper end walls 136—136—136—136 and lower end walls 134—134—134—134.

Recess 132 in lower end wall 134 is one inch (1") long and is bisected by fold line 124. Recess 132 is three-sixteenths inches (3/16") deep in lower end wall 134. Recess 130 along lower end wall 134 is also one inch (1") long and is bisected by fold line 128. Recess 130 is also three-sixteenths inches (3/16") deep in lower end wall 134.

The elongated slots 78 utilized to form fold lines between the four upstanding load supporting panels 116, 118, 120 and 122 are each two inches (2") long and one-eighth inch (⅛") wide. There are three slots 78 on each fold line 90, 124, 126, and 128 comprising a total of twelve slots 78 in blank 12. The four slots 78 nearest upper end wall 136 are each positioned three inches (3") from upper end wall 136 as measured from the outside ends of the four slots 78 to end wall 136 along the fold lines 90, 124, 126 and 128. The four slots 78 nearest lower end wall 134 are each positioned three inches (3") from lower end wall 134 as measured from the outside ends of the four slots to the lower end wall 134 along fold lines 90, 124, 126 and 128. The four slots intermediate or in between the other eight slots are each positioned seven inches (7") from upper end wall 136 and seven inches (7") from lower end wall 134 as measured from the ends of the four slots 78 along fold lines 90, 124, 126 and 128.

The two blanks 10 and 12 are connected or combined by sonic welding as hereinbefore mentioned. Four sonic welding tool marks are shown in FIGS. 4 and 5 as circles identified by reference numerals 95—95—95—95. The four sonic welds are spaced apart to provide effective bonding of the panels and flaps. Four welds are used to connect the panels and flaps utilized in this preferred embodiment of the invention and specifically to connect flap 98 to upstanding load supporting panel 70 and specifically to connect flap 42 to upstanding load supporting panel 122. Additional welds could be employed, however, if it is deemed necessary to increase the bond between the two flaps and the two upstanding load supporting panels.

The connectors or connector means utilized in this preferred embodiment of the invention to connect the upstanding load supporting panels to the upstanding end panels and the load supporting panels to each other take the form of strap means or straps, one of which is shown in FIGS. 12 and 13. Referring to FIG. 12, the connector or strap 140 is a polyethylene, injection-molded, one-piece structure. Strap 140 is comprised of an elongated body portion 142 (rectangular in cross section) which measures one-eighth inch (⅛") wide by one-sixteenth inch (1/16") thick and is four and fifteen-sixteenths inches (4 15/16") long including the length of the diameters of the two heads 144–144 or as measured between the perimeters of the heads 144—144. The pins 146—146 having pointed ends 148—148 thereon are connected to one side of each head 144—144 and each are seven-eighths inches (⅞") long as measured between the underside of each head 144 and the end of each pointed end 148. The diameter of each pin 146–146 is three-sixteenths inches (3/16"). The heads 144—144 are integrally connected on one side to pins 146—146 and are also integrally connected to each end of the body portion 142. The heads each have a diameter of five-sixteenths inches (5/16") and are one-sixteenth inch (1/16") thick or the same thickness as the body portion 142. Each strap 140 has a useful, preselected length of five and one-quarter inches (5¼") as measured by the distance between the centerlines of the pins 146–146.

As best seen in FIGS. 22, 23, 25, 26 and 27, the seat or support includes a shoulder strap or carrying strap 158. This shoulder or carrying strap 158 is made of polypropylene webbing which is one inch (1") wide and five feet nine inches (5'9") long.

The VELCRO® hook and loop strips utilized as the quick-connect and disconnect, two-part fasteners are cut to length from woven nylon tapes, hoop tapes and loop tapes. Each woven nylon hoop tape on one side is comprised of minute, flexible hooks and on the reverse or back side takes the form of a flat smooth surface to which an adhesive can be applied. Each woven nylon loop tape is comprised of small soft loops on one side and on the reverse or back side also takes the form of a flat smooth surface to which an adhesive can be applied. When the tapes are cut to a given length to form strips for use as fasteners as in the instant seat or support, the hook and loop surfaces of the strips when pressed together or moved into engagement with each other, form a tight bond or become tightly fastened together. The two strips so connected can be quickly and easily separated or disengaged by simply pulling the two strips apart.

The reverse or back side of each hook and loop strip is rigidly attached in preselected positions to the COROPLAST® panels and flaps by using an adhesive which effectively and tightly secures the flat or reverse sides of the strips to the COROPLAST®. The adhesive used in this preferred embodiment of the invention is sold or marketed by VELCRO USA, Inc. and is identified as VELCRO adhesive TEMPO™ (0114). This particular adhesive is a strong, rubber-based, pressure sensitive adhesive. The adhesive is characterized by being quick setting, achieving 90% bond strength in about one hour, achieving full bond strength in 24 hours, and having a temperature operating range of 0 degrees Fahrenheit to 160 degrees Fahrenheit. This adhesive is applied to the reverse sides of the hook and loop tapes in the form of a pre-coated pressure sensitive adhesive so that the hook and loop strips cut from the tapes can be easily applied to the COROPLAST® panels and flaps by merely being pressed into engagement with the COROPLAST® in the preselected positions.

This VELCRO® TEMPO™ (0114) adhesive is considered to be the best adhesive for securing the hook and loop strips to the COROPLAST® panels and flaps and is thus, as of the date of filing of this application, considered to be the best mode of securing the VELCRO® strips to the COROPLAST® panels and flaps.

The VELCRO® woven nylon hook tapes are sold or marketed by VELCRO USA, Inc. with the pressure sensitive adhesive pre-applied to the reverse side of the hook tapes. The nylon hook tapes with the pressure sensitive adhesive pre-applied are identified by VELCRO USA, Inc. as catalog or product number (RGH088). This combination product is sold by VELCRO USA, Inc. in the form of tapes which are twenty five feet (25') long and one inch (1") wide and these tapes are identified by VELCRO® as part number (184256).

The VELCRO® woven nylon loop tapes are sold or marketed by VELCRO USA, Inc. with the pressure sensitive adhesive pre-applied to the reverse side of the loop tapes. The nylon loop tapes with the pressure sensitive adhesive pre-applied are identified by VELCRO USA, Inc. as catalog or product number (RGL001). This combination product is also sold by VELCRO USA, Inc. in the form of tapes which are twenty five feet (25') long and one inch (1") wide and these tapes are identified by VELCRO® as part number (184255). The trademarks VELCRO® and TEMPO™ (0114) are owned by VELCRO USA, Inc.

The VELCRO® hook and loop strips utilized in the preferred embodiment of the invention are cut from VELCRO® hook and loop tapes with the pressure sensitive adhesive pre-applied on the reverse side of the tapes. The strips are each three inches(3") longs and one inch (1") wide. Eight strips are utilized, four loop strips and four corresponding or mating hook strips.

As best seen in FIGS. 19 and 20, a loop strip 149 is secured to the inside surface of flap 106 on top panel 102. The loop strip 149 is positioned such that the longitudinal axis or center line thereof (not shown) is parallel with and spaced nine-sixteenth inches (9/16") from the three inch (3") long end wall or free end of flap 106. The loop strip 149 is also positioned such that the three inch (3") length thereof is bisected by the longitudinal axis or centerline (not shown) of top panel 102 and flap 106. The corresponding or mating hook strip 150 (FIG. 20) is positioned on the outside surface of upstanding end panel 38 such that the three inch (3") length thereof is bisected by the longitudinal axis or centerline (not shown) of upstanding end panel 38 (strip centered on upstanding end panel 38). The longitudinal axis of hook strip 150 is also positioned parallel with and spaced four and three-quarters inches (4¾") from top end wall 60 of upstanding end panel 38.

As best seen in FIG. 22, the loop strip 151 is secured to the inside surface of flap 48 on bottom panel 44. The loop strip 151 is positioned such that the longitudinal axis thereof (not shown) is parallel with and spaced nine-sixteenths inches (9/16") from the three inch (3") long end wall or free end of flap 48. The loop strip 151 is also positioned such that the three inch (3") length thereof is bisected by the longitudinal axis or centerline (not shown) of bottom panel 44 and flap 48. The hook strip 152 is positioned on the outside surface of upstanding end panel 94 such that the three inch (3") length thereof is bisected by the longitudinal axis or centerline (not shown) of upstanding end panel 94 (strip centered on upstanding end panel 94). The longitudinal axis of hook strip 152 is also positioned parallel with and spaced four and three-quarter inches (4¾") from bottom end wall 100 of upstanding end panel 94.

As best seen in FIG. 22, loop strip 153 is secured to the outside surface of flap 106 on top panel 102. The loop strip 153 is positioned such that the longitudinal axis (not shown) is parallel with and spaced nine-sixteenth inches (9/16") from the three inch (3") long end wall or free end of flap 106. The loop strip 153 is also positioned such that the three inch (3") length threrof is bisected by the longitudinal axis or centerline (not shown) of top panel 102 and flap 106 (strip centered on flap 106). The corresponding hook strip 154 is positioned on the inside surface of bottom panel 44 such that the three inch (3") length thereof is bisected by the longitudinal axis or centerling (not shown) of bottom panel 44 (strip centered on bottom panel 44). The longitudinal axis of strip 154 is also positioned parallel with and spaced two and three-quarter inches (2¾") from fold line 36 integrally connecting upstanding end panel 38 and bottom panel 44.

As best seen in FIGS. 16 and 19, loop strip 155 (FIG. 16) is secured to the outside surface of flap 48 on bottom panel 44. The loop strip 155 is positioned such that the longitudinal axis (not shown) is parallel with and space nine-sixteenths inches (9/16") from the three inch (3") long end wall or free end of flap 48. The loop strip 155 is also positioned such that the three inch (3") length thereof is bisected by the longitudinal axis or centerline (not shown) of bottom panel 44 and flap 48 (strip centered on flap 48). The corresponding or mating strip 156 (FIG. 19) is positioned on the inside surface of top panel 102 such that the three inch (3") length thereof is bisected by the longitudinal axis or centerline (not shown) of top panel 102 (strip centered on top panel 102). The longitudinal axis of strip 156 is also positioned parallel with and spaced two and three-quarter inches (2¾") from fold line 92 integrally connecting upstanding end panel 94 and top panel 102.

Referring to FIG. 10, upstanding end panel 38 and bottom panel 44 are integrally connected along fold line 36. Upstanding end panel 38 is eleven inches (11") wide and bottom panel 44 is twelve inches (12") side including the two one-half inch (½") wide overhang portions 51–53. Upstanding end panel 38 and bottom panel 44 are each sixteen and three thirty-seconds inches (16 3/32") long or the same length.

The upstanding load supporting panel 64 is sixteen inches (16") long and is integrally connected to upstanding end panel 38 along fold line 34. The upstanding load supporting panel 64 is three thirty-seconds inches (3/32") shorter or less in length than upstanding end panel 38 and thus there is a space or distance between the lower end wall 80 of upstanding load supporting panel 64 and the fold line 36 (or fold line 36 extended) of three thirty-seconds inches (3/32"). The construction of upstanding end panel 38 and upstanding load supporting panel 122 on the opposite side of upstanding end panel 38 along fold line 32 forms an identical dimension in that there is an identical space or distance between lower end wall 134 of upstanding load supporting panel 122 and fold line 36 (or fold line 36 extended) of three thirty-seconds inches (3/32").

The overhang portions 51 and 53 on bottom panel 44 are each cut or reduced in length by three thirty-seconds inches (3/32") and are also cut to a depth of one-half inch (½") so that the material removed from each overhang portion forms end walls 57 and 59 on the overhang portions 51 and 53. At the same time, the material removed forms an L-shaped shoulder (no reference numeral) on each side of bottom panel 44. One side of the L-shaped shoulder is formed by the end walls 57 and 59 and the other side of each L-shaped shoulder is formed by a short side wall (no reference numeral) on each side of bottom panel 44 that intersects the two end walls 57 and 59 on the overhang portions 51 and 53. The two short side walls on bottom panel 44 are in alignment with fold lines 32 and 34. The two short side walls each have a length of three thirty-seconds inches (3/32"). Consequently, there is a distance or space between the end walls 57 and 59 of overhang portions 51 and 53 and fold line 36 (or fold line 36 extended) of three thirty-seconds inches (3/32").

The total space or distance between each end wall 57 and 59 of the overhangs portions 51 and 53 and each lower end wall 80 and 134 of upstanding load supporting panels 64 and 122 is three sixteenths inches (3/16") or a combination of the two three thirty-seconds inches (3/32") spaces. The two three thirty-seconds inches (3/32") spaces or distances form a pair of slots 55—55 on opposite ends of fold line 36 and the two slots are bisected by fold line 36 or by fold line 36 extended.

The three thirty-seconds inches (3/32") space between fold line 36 and the lower end walls 80—80—80—80 and 134—134—134—134 of the first and second plurality of upstanding load supporting panels 62 and 114 (FIGS. 14 and 22) permits the bottom panel 44 to be folded in both directions around fold line 36 without obstruction. The three thirty-seconds inches (3/32") space, in particular, permits bottom panel 44 (FIG. 22) to be folded in a clockwise direction around fold line 36 and lay flat against the lower end walls 80—80—80—80 and 134—134—134—134 and bottom end wall 100 of upstanding end panel 94, when the panels and auxiliary components are being folded into an assembled and operable seat or support.

In order for the bottom panel 44 to lay flat on lower end walls 80—80—80—80, 134—134—134—134 and bottom end wall 100, the space between fold line 36 and the lower end walls 80 and 134 of the upstanding load supporting panels must be at least or not less than one-half of the thickness of the COROPLAST® panel 44. The bottom panel 44 has a thickness of 4 millimeters. The space between fold line 36 and the lower end walls of the upstanding load supporting panels must therefore be at least 2 millimeters for the bottom panel to seat properly or seat flat. Since the space necessary for the bottom panel to seat flat must be at least 2 millimeters, the three thirty-seconds inches (3/32") space (2.34 millimeters) in this preferred embodiment of the invention exceeds the 2 millimeter spacing and will thus afford satisfactory performance.

Prior to the blanks 10 and 12 being connected by sonic welding, and during the period when the two blanks 10 and 12 are being cut to size, cut to configuration, and scored to provide fold lines, the two overhang portions 51 and 53 on bottom panel 44 (blank 10) are cut back or reduced in length by three thirty-seconds inches (3/32") and one slot 55 will be formed by the lower end wall 80 of upstanding load supporting panel 64 and the end wall 59 on overhang portion 53. This single slot 55 will have a total width of three sixteenths inches (3/16"). This total width provides sufficient space for a scoring tool to be applied to the COROPLAST® blank 10 to accurately establish fold line 36 and thereby accurately form integral upstanding end panel 38 and integral bottom panel 44. When the two blanks 10 and 12 are subsequently connected by being welded, the second slot 55 will be formed by the lower end wall 134 of upstanding load supporting panel 122. Moreover, the length of the two overhang portions 51 and 53 can be further shortened as needed to accommodate certain scoring tools that may require additional space.

Referring to FIG. 11, upstanding end panel 94 and top panel 102 are integrally connected along fold line 92. Upstanding end panel 94 is eleven inches (11") wide and top panel 102 is twelve inches (12") wide including the two one-half inch (½") wide overhang portions 101 and 103. Upstanding end panel 94 and top panel 102 are each sixteen and three thirty-seconds inches (16 3/32") long or the same length.

The upstanding load supporting panel 16 is sixteen inches (16") long and is integrally connected to upstanding end panel 94 along fold line 90. The upstanding load supporting panel 116 is three thirty-seconds inches (3/32") shorter or less in length than upstanding end panel 94 and thus there is a space or distance between the upper end wall 136 of upstanding load supporting panel 116 and the fold line 92 (or fold line 92 extended) of three thirty-seconds inches (3/32"). The construction of upstanding end panel 94 and upstanding load supporting panel 70 on the opposite side of upstanding end panel 94 along fold line 88 forms an identical dimension in that there is an identical space or distance between upper end wall 86 of upstanding load supporting panel 70 and fold line 92 (or fold line 92 extended) of three thirty-seconds inches (3/32").

The overhang portions 101 and 103 on top panel 102 are each cut or reduced in length by three thirty-seconds inches (3/32") and are also cut to a depth of one-half inch (½") so that the material removed from each overhang portion forms end walls 107 and 109 on the overhang portions 101 and 103. At the same time, the material removed forms an L-shaped shoulder (no reference numeral) on each side of top panel 102. One side of the L-shaped shoulder is formed by the end walls 107 and 109 and the other side of each L-shaped shoulder is formed by a short side wall (no reference numeral) on each side of top panel 102 that intersects the two end walls 107 and 109 on the overhang portions 101 and 103. The two short side walls on top panel 102 are in alignment with fold lines 88 and 90. The two short side walls each have a length of three thirty-seconds inches (3/32"). Consequently, there is a distance or space between the end walls 107 and 109 of overhang portions 101 and 103 and fold line 92 (or fold line 92 extended) of three thirty-seconds inches (3/32").

The total space or distance between each end wall 107 and 109 of the overhangs portions 101 and 103 and each upper end wall 86 and 136 of upstanding load supporting panels 70 and 116 is three sixteenths inches (3/16") or a combination of the two, three thirty-seconds inches (3/32") spaces. The two, three thirty-seconds inches (3/32") spaces or distances form a pair of slots 105—105 on opposite ends of fold line 92 and the two slots are bisected by fold line 92 or by fold line 92 extended.

The three thirty-seconds inches (3/32") space between fold line 92 and the upper end walls 86—86—86—86 and 136—136—136—136 of the first and second plurality of upstanding load supporting panels 62 and 114 (FIGS. 19 and 20) permits the top panel 102 to be folded in both directions around fold line 92 without obstruction. The three thirty-seconds inches (3/32") space, in particular, permits top panel 102 (FIG. 19) to be folded in a clockwise direction around fold line 92 and lay flat against the upper end walls 86—86—86—86 and 136—136—136—136 and top end wall 60 of upstanding end panel 38, when the panels and auxiliary components are being folded into an assembled and operable seat or support.

In order for the top panel 102 to lay flat on upper end walls 86—86—86—86, 136—136—136—136 and top end wall 60, the space between fold line 92 and the upper end walls 86 and 136 of the upstanding load supporting panels must be at least or not less than one-half of the thickness of the COROPLAST® panel 102. The top panel 102 has a thickness of 4 millimeters. The space between fold line 92 and the upper end walls of the upstanding load supporting panels must therefore be at least 2 millimeters for the top panel to seat properly or seat flat. Since the space necessary for the top panel to seat flat must be at least 2 millimeters, the three thirty-seconds inches (3/32") space (2.34 millimeters) in this preferred embodiment of the invention exceeds the 2 millimeter spacing and will thus afford satisfactory performance.

Prior to the blanks 10 and 12 being connected by sonic welding, and during the period when the two blanks 10 and 12 are being cut to size, cut to configuration, and scored to provide fold lines, the two overhang portions 101 and 103 on top panel 102 (blank 12) are cut back or reduced in length by three thirty-seconds inches (3/32") and one slot 105 will be formed by the upper end wall 136 of upstanding load supporting panel 116 and the end wall 109 on overhang portion 103. This single slot 105 will have a total width of three sixteenths inches (3/16"). This total width provides sufficient space for a scoring tool to be applied to the COROPLAST® blank 12 to accurately establish fold line 92 and thereby accurately form integral upstanding end panel 94 and integral bottom panel 102. When the two blanks 10 and 12 are subsequently connected by being welded, the second slot 105 will be formed by the upper end wall 86 of upstanding load supporting panel 70. Moreover, the length of the two overhang portions 101 and 103 can be further shortened as needed to accommodate certain scoring tools that may require additional space.

Referring to FIGS. 1, 2 and 18, the assembled and operable seat or support has an overall height of sixteen and three-eighths inches (16 3/8") as measured from the outside surface of the top panel 102 to the outside surface of the bottom panel 44. The overall length is sixteen and three-thirty-seconds inches (16 3/32") as measured between fold line 92 and fold line 104. The overall depth or width (FIGS. 1 and 2) is twelve inches (12") as measured between the parallel free ends of the top and bottom overhang portions 101 and 103 and 51 and 53.

As best shown in FIG. 27, when the assembled and operable seat or support is converted into a tightly secured and self-contained compact bundle or package, the overall length of the bundle or package is sixteen and three-eighths inches (16 3/8") as measured between the outer surface of the rectangular portion of flap 106 and the outer surface of the rectangular portion of flap 48. The overall thickness of the assembled and operable seat or support when converted into a tightly secured and self-contained compact bundle or package is two inches (2") as measured between fold line 104 and fold line 108.

While the invention has been described and illustrated in detail, it is to be clearly understood that this is intended by way of illustration and example only and is not to be taken by way of limitation, the spirit and scope of this invention being limited only by the appended claims.

I claim:

1. A foldable seat, which can also function as a support, structured from one or more blank means cut and scored to provide fold lines and foldable component means integrally formed with said blank means along said fold lines, said seat comprising:

end wall means, bottom and top panel means integrally and foldably connected at one end to said end wall means and releasably connected at an opposite end to said end wall means, load supporting means integrally and foldably connected at one end to said end wall means and rigidly connected at the opposite end to said end wall means, and means connected to said end wall means and said load supporting means for positioning said load supporting means between said end wall means and said top and bottom panel means for supporting a load applied to said top panel means and thereby applied to said seat.

2. A foldable seat, which can also function as a support, structured from one or more sheets cut and scored to provide fold lines and foldable components integrally formed with said sheets along said fold lines, said seat comprising:

a pair of oppositely disposed end walls, a bottom panel integrally and foldably connected at one end to one end wall and releasably connected at another end to a second end wall, a top panel integrally and foldably connected at one end to another end wall and releasably connected at another end to said one end wall, load supporting panels integrally and foldably connected at one end to said end walls and rigidly secured at an opposite end to said end walls, and means connected to said end walls and said load supporting panels for positioning said load supporting panels between said end walls and said top and bottom panels for supporting a load applied to said top panel and thereby applied to said seat.

3. A foldable seat, which can also function as a support, including one or more sheets cut and scored to provide fold lines and foldable components integrally formed with said sheets along said fold lines for folding said components into an operable assembly, said seat comprising:

a first upstanding end wall, a second upstanding end wall, a plurality of load supporting panels foldably connected to said first end wall and rigidly secured to said second end wall, a plurality of load supporting panels foldably connected to said second end wall and rigidly secured to said first end wall, means connected to said end walls and said load supporting panels for positioning said load supporting panels between said end walls for supporting a load, a bottom panel foldably connected to said first end wall and releasably connected to said second end wall for supporting a load carried by said load supporting panels and for securely holding the components of said seat in assembly, and a top panel foldably connected to said second end wall and releasably connected to said first end wall for carrying a load applied to said foldable seat, for imparting said load to said end wall, said load supporting panels and said bottom panel, and for securely holding the components of said seat in said assembly.

4. A lightweight, waterproof and foldable seat, which can also function as a support structured from one or more sheets made of a lightweight and waterproof material and having integral and foldable components, said seat comprising:

a first upstanding end panel terminating at one end in a top end wall, a second upstanding end panel terminating at one end in a bottom end wall, a bottom panel integrally and foldably connected at one end to the bottom of said first end panel and releasably secured at an opposite end to the bottom portion of said second end panel, a top panel integrally and foldably connected at one end to the top of said second end panel and releasably secured at an opposite end to a top portion of said first end panel, a plurality of foldable upstanding load supporting panels integrally and foldably connected at one end to one side of said first end panel and rigidly secured at an opposite end to a corresponding side of said second end panel, said load supporting panels terminating at one end in an upper end wall and terminating at an opposite end in a lower end wall, a plurality of foldable upstanding load supporting panels foldably and integrally connected at one end to an opposite side of said second end panel and rigidly secured at an opposite end to a corresponding side of said first end panel, said load supporting panels terminating at one end in an upper end wall and terminating at a opposite end in a lower end wall, and means connected to said end panels and said load supporting panels for positioning said load supporting panels between said end panels and said top and bottom panels, said load supporting panels, engaging at their upper and lower end walls with said top and bottom panels, respectively, and thereby supporting a load applied to said top panel, said top and bottom panels, when releasably secured to said end panels, engaging the top and bottom end walls, respectively, of said end panels, said components of said seat, in combination, thereby supporting a load applied to said seat or support.

5. A lightweight, waterproof and foldable seat, which can also function as a support structured from one or more sheets made of a lightweight and waterproof material and cut and scored to provide fold lines and integral and foldable components having inside and outside surfaces when assembled into an operable seat, said seat comprising a first upstanding end panel having inside and outside surfaces and terminating at one end in a top end wall, said end panel having an integral and foldable flap connected to one side thereof along a fold line, a second upstanding end panel having inside and outside surfaces and terminating at one end in a bottom end wall, said second end panel having a flap integrally and foldably connected thereto along one side thereof along a fold line, a bottom panel integrally and foldably connected at one end along a fold line to a bottom of said first end panel and terminating at an opposite end along a fold line, said bottom panel at an opposite end along said fold line having an integral and foldable flap extending therefrom for releasably securing said bottom panel to an outside surface of a bottom portion of said second end panel, said bottom panel engaging a bottom end wall of said second end panel when a flap on said bottom panel is releasably secured to the outside surface of a bottom portion of said second end panel, a top panel integrally and foldably connected at one end along a fold line to the top of said second end panel and at an opposite end terminating along a fold line, said top panel at the opposite end along said fold line having an integral and foldable flap extending therefrom for releasably securing said top panel to an outside surface of a top portion of said first end panel, said top panel engaging the top end wall of said first end panel when said flap on said top panel is releasably secured to the outside surface of the top portion of said first end panel, a first plurality of integral and foldable upstanding load supporting panels foldably connected along fold lines and terminating at each extremity in an end panel with one of said load supporting end panels being foldably connected along a fold line to one side of said first upstanding end panel and with another end panel being rigidly secured to said integral and foldable flap on a corresponding side of said second upstanding end panel, said first plurality of upstanding load supporting panels all terminating at one end in an upper end wall and all terminating at a opposite end in a lower end wall, a second plurality of integral and foldable upstanding load supporting panels foldably connected along fold lines and terminating at each extremity in an end panel with one of said end panels being foldably connected along a fold line to one side of said second upstanding end panel and with the other end panel being rigidly secured to said integral and foldable flap on a corresponding side of said first upstanding end panel, said second plurality of upstanding load supporting panels all terminating at one end in an upper end wall and all terminating at an opposite end in a lower end wall, and means connected to said upstanding end panels and said first and second plurality of load supporting panels for holding the foldable panels in a partially folded triangular configuration with the panels intersecting each other along the fold lines, connecting the panels and for positioning said first and second plurality of load supporting panels to be held between said upstanding end panels and said top and bottom panels for supporting a load applied to said top panel, said means for holding and positioning said first and second plurality of load supporting panels interconnecting and securing said panels such that said load supporting panels intersect each other and intersect said upstanding end panels within a preselected range of degrees, said load supporting panels, engaging at said upper and lower end wall, said top and bottom panels, respectively, and said top and bottom panels, when releasably secured to said upstanding end panels, engaging the top and bottom end walls, respectively, of said end panels, said load supporting panels and said top and bottom panels stabilizing the components of said seat and holding the components of said seat in tight assembly, said components of said seat, when assembled, providing a means for supporting a load applied to said top panel of said seat and thereby providing a means for supporting a load applied to said seat.

6. A lightweight, waterproof and foldable seat, which can also function as a support structured from two sheets made of corrugated plastic and cut and scored to provide fold lines and integral and foldable components having inside and outside walls when assembled into an operable seat or support said seat comprising:

said corrugated plastic consisting of polypropylene copolymers extruded into corrugated plastic sheets comprised of two sheets of said plastic integrally connected by a plurality of longitudinally extending ribs that define a plurality of longitudinally extending passageways extending the length of said corrugated sheets, said flutes having a predetermined width and being spaced a preselected distance apart with said flutes in combination with said twin panels defining said longitudinally extending passageways, end walls of said corrugated plastic sheets consisting of end walls of said sheets and end walls of said flutes with the end walls defining exposed ends of said longitudinally extending passageways, said ends of said longitudinally extending passageways also being exposed when said end walls of said plastic sheets are cut or recessed and when said plastic sheets are other wise cut or slotted, a first upstanding end panel having inside and outside walls and terminating at one end in a top end wall having a pair of integral and spaced tabs extending therefrom, said tabs having a preselected length and width and being spaced a preselected distance apart, said first upstanding end panel having an integral and foldable flap connected to one side thereof along a fold line, a second upstanding end panel having inside and outside surfaces and terminating at one end in a bottom end wall having a pair of integral and spaced tabs extending therefrom, said tabs having a preselected length and width and being spaced a preselected distance apart, said bottom end wall having a pair of recesses or cutouts therein adjoining inner ends of said pair of tabs on said end wall with the recesses providing access at a different level to the ends of the passageways in the bottom end wall of said second upstanding end panel, said second upstanding end panel having a flap integrally and foldably connected thereto along one side thereof along a fold line, a bottom panel integrally and foldably connected at one end along a fold line to a bottom of said first upstanding end panel and terminating at an opposite end along a fold line, said bottom panel at the opposite end along said fold line having an integral and foldable flap extending therefrom for releasably securing said bottom panel to the outside surface of the bottom portion of said second upstanding end panel, said bottom panel and said foldable flap extending therefrom having a pair of slots therein positioned along and on both sides of said fold line and spaced a preselected distance apart for receiving said pair of tabs extending from the bottom end wall of said second upstanding end panel when said flap is folded along said fold line and is releasably secured to the outside surface of the bottom portion of said second upstanding end panel, said flap near an outer end thereof on an inside surface of said flap having one part of a two-part fastener rigidly secured thereto with said one part of said two-part fastener being adapted to mate or coact with a second part of said two-part fastener rigidly secured to the outside surface of the bottom portion of said second upstanding end panel, said pair of tabs, said pair of slots receiving said tabs and said two-part fastener securely holding said bottom panel, said flap extending therefrom and said second upstanding end panel in tight assembly with said two-part fastener at the same time affording a quick and easy release of said flap and said bottom panel from said second upstanding end panel, said bottom panel engaging the bottom end wall of said second end panel on both sides of said pair of tabs extending therefrom when said tabs are received in said pair of slots positioned along and on both sides of said fold line between said bottom panel and said flap and when said flap is firmly and releasable secured by said two-part fastener to the outside surface of the bottom portion of said second upstanding end panel, said bottom panel and said first upstanding end panel on the fold line interconnecting the two panels having a pair of small slots therein spaced a preselected distance apart, said slots providing access to the ends of the longitudinally extending passageways in the first upstanding end panel, a top panel integrally and foldably connected at one end along a fold line to the top of said second upstanding end panel and at the opposite end terminating along a fold line, said top panel at the opposite end along said fold line having an integral and foldable flap extending therefrom for releasably securing said top panel to the outside surface of the top portion of said first end panel, said top panel and said foldable flap extending therefrom having a pair of slots therein positioned along and on both sides of said fold line spaced a preselected distance apart for receiving said pair of tabs extending from the top end wall of said first upstanding end panel when said flap is folded along said fold line and is releasably secured to the outside surface of the top portion of said first upstanding end panel, said flap near the outer end thereof on the inside surface of the flap having one part of a two-part fastener rigidly secured thereto with said one part of said two-part fastener being adapted to mate or coact with a second part of said two-part fastener rigidly secured to the outside surface of the top portion of said first upstanding end panel, said pair of tabs, said pair of slots receiving said tabs and said two-part fastener securely holding said top panel, said flap extending therefrom and said first upstanding end panel in tight assembly with said two-part fastener at the same time affording a quick and easy release of said flap and said top panel from said first upstanding end panel, said top panel engaging the top end wall of said first upstanding end panel on both sides of said pair of tabs extending therefrom when said tabs are received in said pair of slots positioned along and on both sides of said fold line between said top panel and said flap and when said flap is firmly and releasably secured by said two-part fastener to the outside surface of the top portion of said first upstanding end panel, a first plurality of integral and foldable upstanding load supporting panels foldably interconnected along fold lines and terminating at each extremity in an end panel with one of said load supporting end panels being foldably connected along a fold line to one side of said first upstanding end panel and with the other end panel being rigidly secured to said integral and foldable flap on the corresponding side of said second upstanding end panel, said upstanding load supporting panels each terminating at one end in an upper end wall and terminating at the opposite end in a lower end wall, said lower end walls of said first plurality of load supporting panels being cut or recessed at two fold lines or where pairs of said panels intersect each other with said recesses providing access at a different level to the ends of said passageways in said lower end walls of said load supporting panels, a second plurality of integral and foldable upstanding load supporting panels foldably interconnected along fold lines and terminating at each extremity in an end panel with one of said end panels being foldably connected along a fold line to one side of said second upstanding end panel and with the other end panel being rigidly secured to said integral and foldable flap on the corresponding side of said first upstanding end panel, said upstanding load supporting panels each terminating at one end in an upper end wall and terminating at the opposite end in a lower end wall, said lower end walls of said second plurality of load supporting panels being cut or recessed at two fold lines or where pairs of said panels intersect each other with said recesses providing access at a different level to the ends of said passageways in said lower end walls of said load supporting panels, and a first plurality of substantially identical connector means each having a preselected length and having a pin on each end thereof for connecting said first upstanding end panel to said first and second plurality of load supporting panels, said first plurality of said connector means each having the pins on one end thereof received and anchored in the ends of the passageways terminating in said pair of small slots along the fold line connecting said bottom panel and said first upstanding end panel and having the pins on the opposite end thereof received and anchored in the ends of the passageways in the recesses in the lower end walls of said first and second plurality of the upstanding load supporting panels at said fold lines or where said pairs of said panels intersect each other, a second plurality of substantially identical connector means each having a preselected length and having a pin on each end thereof for connecting said second upstanding end panel to said first and second pluralities of upstanding load supporting panels, said second plurality of said connector means each having pins on one end thereof received and anchored in the ends of the passageways in said pair of recesses adjoining the inner ends of said pair of tabs extending from the bottom end wall of said second upstanding end panel and each having the pins on the opposite ends thereof received and anchored in the ends of the passageways in the recesses in the lower end walls of said first and second plurality of upstanding load supporting panels at said fold line or where said pairs of said panels intersect each other, a third plurality of substantially identical connector means each having a preselected length and a pin on each end thereof for connecting pairs of panels in each of said first and second plurality of upstanding load supporting panels, said third plurality of said connector means each having the pins on each end thereof received and anchored in the ends of the passageways in the lower end walls of a pair of intersecting panels in each of said first and second upstanding load supporting panels with said pins being anchored in the ends of said passageways in said lower end walls of each pair of intersecting panels in preselected positions, said connector means interconnecting said upstanding end panels and said upstanding load supporting panels and thereby holding the foldable panels in each plurality in a partially folded triangular configuration with the panels in each plurality intersecting each other along the fold lines and positioning said first and second plurality of load supporting panels, so held, between said upstanding end panels and said top and bottom panels for supporting a load applied to said top panel, said connector means for holding and positioning said first and second plurality of load supporting panels interconnecting and securing said panels such that said load supporting panels intersect each other and intersect said upstanding end panels at angles falling within a preselected range of degrees, said load supporting panels, when so held and positioned, engaging at their upper and lower end walls, said top and bottom panels, respectively, and said top and bottom panels, when releasably secured to said upstanding end panels, engaging the top and bottom walls, respectively, of said end panels, said load supporting panels when so held and positioned and said top and bottom panels when so releasably secured stabilizing the components of said seat and holding the components of said seat in tight assembly, said components of said seat, when so assembled, providing a means for supporting a load applied to said top panel of said seat and thereby providing a means for supporting a load applied to said seat or support.

7. A lightweight, waterproof and foldable seat as claimed in claim 6 wherein said seat is made from two sheets of corrugated plastic.

8. A lightweight, waterproof and foldable seat as claimed in claim 6 wherein said seat is made from a single sheet of corrugated plastic.

9. A lightweight, waterproof and foldable seat as claimed in claim 6 wherein said sheets of corrugated plastic each have a thickness of 4.0 millimeters and have a weight of 1000 grams per square meter.

10. A lightweight, waterproof and foldable seat as claimed in claim 6 wherein said upstanding load supporting panels are shorter in length than said upstanding end panels, wherein each of said load supporting panels has the same dimensions in length and width, and wherein said first and second plurality of load supporting panels are each comprised of four panels.

11. A lightweight, waterproof and foldable seat as claimed in claim 6 wherein said connector means connecting said upstanding end panels to said upstanding load supporting panels and connecting said pairs of panels are each comprised of a strap terminating at each end in a head having a pin extending therefrom approximately normal to the longitudinal axis of said strap, said pins being dimensioned to tightly fit within said passageways in said upstanding end panels and in said upstanding load supporting panels.

12. A lightweight, waterproof and foldable seat as claimed in claim 6 wherein said connector means for positioning said load supporting panels interconnect and secure said panels such that said load supporting panels intersect each other at angles in a range of 89 to 94 degrees and intersect said upstanding end panels at angles in a range of 43 to 47 degrees.

13. A lightweight, waterproof and foldable seat as claimed in claim 6 wherein said upstanding tabs on the top end wall of said first upstanding end panel and said tabs on the bottom end wall of said second upstanding end panel each have a length of $^{2.5}/_{11}$ of the width of said end panels, are spaced apart at their inside ends by $^{4}/_{11}$ of the width of said upstanding end panels, and at their outside ends are each spaced from the ends of each end panel by $^{1}/_{11}$ of the width of each upstanding end panel.

14. A lightweight, waterproof and foldable seat as claimed in claim 6 wherein said other end panel on said first plurality of upstanding load supporting panels is rigidly secured to said integral and foldable flap on the corresponding side of said second upstanding end panel by sonic welding, the inside surface on said end panel being sonically welded to the outside surface of said foldable flap at a plurality of points along the outside surface of said end panel, said sonic welds at said plurality of points fusing the inside surface of said end panel at said weld points to the outside surface of said foldable flap.

15. A lightweight, waterproof and foldable seat as claimed in claim 6 wherein said other end panel on said second plurality of upstanding load supporting panels is rigidly secured to said integral and foldable flap on the corresponding side of said first upstanding end panel by sonic welding, the inside surface on said end panel being sonically welded to the outside surface of said foldable flap at a plurality of points along the outside surface of said end panel, said sonic welds at a plurality of points fusing the inside surface of said end panel at said weld points to the outside surface of said foldable flap.

16. A lightweight, waterproof and foldable seat as claimed in claim 6 wherein said two-part fasteners take the form of, hook and loop fasteners with the hook part of the fasteners being rigidly secured to the outside surfaces of said first and second upstanding end panels and with the loop part of said fasteners being rigidly secured to the inside surfaces of the flaps connected to the top and bottom panels.

17. A lightweight, waterproof and foldable seat as claimed in claim 16 wherein said each of said two-part fasteners are rigidly secured to the inside surfaces of said flaps and to the outside surfaces of said first and second upstanding end panels by means of a rubber-based pressure sensitive adhesive.

18. A lightweight, waterproof and foldable seat as claimed in claim 6 wherein said first plurality of upstanding load supporting panels consist of four panels and said second plurality of upstanding load supporting panels consist of four panels, said first and second plurality of load supporting panels when held and positioned by said connector means being held in a partially folded triangular configuration with pairs of panels in each plurality intersecting each other and forming triangles in said triangular configurations with said pairs of panels intersecting each other and forming triangles having angles of intersection within a preselected range of degrees and with the apexes of two triangles in each plurality extending inwardly of said top and bottom panels to provide load support distributed evenly and effectively over the surfaces of said top and bottom panels.

19. A lightweight, waterproof and foldable seat as claimed in claim 6 wherein said first and second plurality of foldable upstanding load supporting panels are foldably connected along fold lines extending the length of each panel, said fold lines being established by cutting a plurality of elongated slots in a passageway between flutes with said fold lines being spaced a preselected distance apart and thus defining the width of each upstanding load supporting panel.

20. A lightweight, waterproof and foldable seat as claimed in claim 6 wherein each slot in each pair of slots positioned along and on both sides on said fold lines connecting said top and bottom panels and the flaps extending therefrom is comprised of a rectangular shaped portion cut into said top and bottom panels along said fold lines and is dimensioned to snugly receive one of the upstanding tabs on the top and bottom end walls of said upstanding end panels and is further comprised of an outwardly flared portion cut along said fold line into each of said flaps with said outwardly flared portion functioning as a guide to direct one of said tabs into said rectangular portion of each slot when said top and bottom panels are releasably secured to said upstanding end panels by said two part fasteners positioned on said end panels and said flaps on said top and bottom panels.

21. A lightweight, waterproof and foldable seat, which can also function as a support structured from one or more sheets made of corrugated plastic and cut and scored to provide fold lines and integral and foldable components having inside and outside surfaces when assembled into an operable seat said seat comprising:

said corrugated plastic consisting of polypropylene copolymers extruded into corrugated plastic sheets comprised of two sheets of said plastic integrally connected y a plurality of longitudinally extending ribs that define a plurality of longitudinally extending passageways extending the length of said corrugated sheets, said flutes having a predetermined width and being spaced a preselected distance apart with said flutes in combination with said twin panels defining said longitudinally extending passageways, the end walls of said corrugated plastic sheets consisting of the end walls of said sheets or panels and the end walls of said flutes with the end walls defining or establishing the exposed ends of said longitudinally extending passageways, said ends of said longitudinally extending passageways also being exposed when said end walls of said plastic sheet are cut or recessed and when said plastic sheets are otherwise cut or slotted, said foldable components of said seat or support also being structured to permit certain components of said assembled and operable seat to be unfolded and thereafter refolded in a certain manner or sequence for a quick conversion into a tightly secured compact bundle or package for carrying, for use as a seat cushion, or for storage, said seat and said compact and tightly secured bundle or package comprising a first upstanding end panel having inside and outside walls or surfaces and terminating at one end in a top end wall having a pair of integral and spaced tabs extending therefrom, said tabs having a preselected length and width and being spaced a preselected distance apart, said first upstanding end panel having an integral and foldable flap connected to one side thereof along a fold line, a second upstanding end panel having inside and outside walls or surfaces and terminating at one end in a bottom end wall having a pair of integral and spaced tabs extending therefrom, said tabs having a preselected length and width and being spaced a preselected distance apart, said bottom end wall having a pair of recesses or cutouts therein adjoining the inner ends of said pair of tabs on said end wall with the recesses providing access at a different level to the ends of the passageways in the bottom end wall of said second upstanding end panel, said second upstanding end panel having a flap integrally and foldably connected thereto along one side thereof along a fold line, a bottom panel integrally and foldably connected at one end along a fold line to the bottom of said first upstanding end panel and terminating at the opposite end along a fold line, said bottom panel at the opposite end along said fold line having an integral and foldable flap extending therefrom for releasably securing said bottom panel to the outside surface of the bottom portion of said second upstanding end panel, said bottom panel and said foldable flap extending therefrom having a pair of slots therein positioned along and on both sides of said fold line and spaced a preselected distance apart for receiving said pair of tabs extending from the bottom end wall of said second upstanding end panel when said flap is folded along said fold line and is releasably secured to the outside surface of the bottom portion of said second upstanding end panel, said flap near the outer end thereof on the inside surface of said flap having one part of a two-part fastener rigidly secured thereto with said one part of said two-part fastener being adapted to mate or coact with a second part of said two-part fastener rigidly secured to the outside surface of the bottom portion of said second upstanding end panel, said pair of tabs, said pair of slots receiving said tabs and said two-part fastener securely holding said bottom panel, said flap extending therefrom and said second upstanding end panel in tight assembly with said two-part fastener at the same time affording a quick and easy release of said flap and said bottom panel from said second upstanding end panel, said bottom panel engaging the bottom end wall of said second end panel on both sides of said pair of tabs extending therefrom when said tabs are received in said pair of slots positioned along and on both sides of said fold line between said bottom panel and said flap and when said flap is firmly and releasable secured by said two-part fastener to the outside surface of the bottom portion of said second upstanding end panel, said bottom panel and said first upstanding end panel on the fold line interconnecting the two panels having a pair of small slots therein spaced a preselected distance apart, said slots providing access to the ends of the longitudinally extending passageways in the first upstanding end panel, a top panel integrally and foldably connected at one end along a fold line to the top of said second upstanding end panel and at the opposite end terminating along a fold line, said top panel at the opposite end along said fold line having an integral and foldable flap extending therefrom for releasably securing said top panel to the outside surface of the top portion of said first end panel, said top panel and said foldable flap extending therefrom having a pair of slots therein positioned along and on both sides of said fold line spaced a preselected distance apart for receiving said pair of tabs extending from the top end wall of said first upstanding end panel when said flap is folded along said fold line and is releasably secured to the outside surface of the top portion of said first upstanding end panel, said flap near the outer end thereof on the inside surface of the flap having one part of a two-part fastener rigidly secured thereto with said one part of said two-part fastener being adapted to mate or coact with a second part of said two-part fastener rigidly secured to the outside surface of the top portion of said first upstanding end panel, said pair of tabs, said pair of slots receiving said tabs and said two-part fastener securely holding said top panel, said flap extending therefrom and said first upstanding end panel in tight assembly with said two-part fastener at the same time affording a quick and easy release of said flap and said top panel from said first upstanding end panel, said top panel engaging the top end wall of said first upstanding end panel on both sides of said pair of tabs extending therefrom when said tabs are received in said pair of slots positioned along and on both sides of said fold line between said top panel and said flap and when said flap is firmly and releasably secured by said two-part fastener to the outside surface of the top portion of said first upstanding end panel, a first plurality of integral and foldable upstanding load supporting panels foldably interconnected along fold lines and terminating at each extremity in an end panel with one of said load supporting end panels being foldably connected along a fold line to one side of said first upstanding end panel and with the other end panel being rigidly secured to said integral and foldable flap on the corresponding side of said second upstanding end panel, said upstanding load supporting panels each terminating at one end in an upper end wall and terminating at the opposite end ill a lower end wall, said lower end walls of said first plurality of load supporting panels being cut or recessed at two fold lines or where pairs of said panels intersect each other with said recesses providing access at a different level to the ends of said passageways in said lower end walls of said load supporting panels, a second plurality of integral and foldable upstanding load supporting panels foldably interconnected along fold lines and terminating at each extremity in an end panel with one of said end panels being foldably connected along a fold line to one side of said second upstanding end panel and with the other end panel being rigidly secured to said integral and foldable flap on the corresponding side of said first upstanding end panel, said upstanding load supporting panels each terminating at one end in an upper end wall and terminating at the opposite end in a lower end wall, said lower end walls of said second plurality of load supporting panels being cut or recessed at two fold lines or where pairs of said panels intersect each other with said recesses providing access at a different level to the ends of said passageways in said lower end walls of said load supporting panels, and a first plurality of substantially identical connector means each having a preselected length and having a pin on each end thereof for connecting said first upstanding end panel to said first and second plurality of load supporting panels, said first pair of said connector means each having the pins on one end thereof received and anchored in the ends of the passageways terminating in said pair of small slots along the fold line connecting said bottom panel and said first upstanding end panel and each having the pins on the opposite end thereof received and anchored in the ends of the passageways in the recesses in the lower end walls of said first and second plurality of the upstanding load supporting panels at said fold lines or where said pairs of said panels intersect each other, a second pair of substantially identical connector means each having a preselected length and having a pin on each end thereof for connecting said second upstanding end panel to said first and second pluralities of upstanding load supporting panels, said second pair of said connector means each having pins on one end thereof received and anchored in the ends of the passageways in said pair of recesses adjoining the inner ends of said pair of tabs extending from the bottom end wall of said second upstanding end panel and each having the pins on the opposite ends thereof received and anchored in the ends of the passageways in the recesses in the lower end walls of said first and second plurality of upstanding load supporting panels at said fold line or where said pairs of said panels intersect each other, a third pair of substantially identical connector means each having a preselected length and a pin on each end thereof for connecting pairs of panels in each of said first and second plurality of upstanding load supporting panels, said third pair of said connector means each having the pins on each end thereof received and anchored in the ends of the passageways in the lower end walls of a pair of intersecting panels in each of said first and second upstanding load supporting panels with said pins being anchored in the ends of said passageways in said lower end walls of each pair of intersecting panels in preselected positions, said connector means interconnecting said upstanding end panels and said upstanding load supporting panels and thereby holding the foldable panels in each plurality in a partially folded triangular configuration with the panels in each plurality intersecting each other along the fold lines and positioning said first and second plurality of load supporting panels, so held, between said upstanding end panels and said top and bottom panels for supporting a load applied to said top panel, said connector means for holding and positioning said first and second plurality of load supporting panels interconnecting and securing said panels such that said load supporting panels intersect each other and intersect said upstanding end panels at angles falling within a preselected range of degrees, said load supporting panels, when so held and positioned, engaging at their upper and lower end walls, said top and bottom panels, respectively, and said top and bottom panels, when releasably secured to said upstanding end panels, engaging the top and bottom walls, respectively, of said end panels, said load supporting panels when so held and positioned and said top and bottom panels when so releasably secured stabilizing the components of said seat and holding the components of said seat in tight assembly, said components of said seat, when so assembled, providing a means for supporting a load applied to said top panel of said seat and thereby providing a means for supporting a load applied to said seat or support, said flap on said bottom panel near the outer end thereof on the outside surface of said flap having one part of a two-part fastener rigidly secured thereto with said one part of said two-part fastener being adapted to mate or coact with a second part of said two-part fastener rigidly secured to the inside surface of said top panel when said assembled and operative seat is converted into a tightly secured compact bundle or package, said flap on said bottom panel having a second fold line therein spaced a preselected distance from and parallel to said first fold line, said flap on said top panel near the outer end thereof on the outside surface of said flap having one part of a two-part fastener rigidly secured thereto with said one part of said two-part fastener being adapted to mate or coact with a second part of said two-part fastener rigidly secured to the inside surface of said bottom panel when said assembled and operative seat is converted into a tightly secured compact bundle or package, said flap on said top panel having a second fold line therein spaced a preselected distance from and parallel to said first fold line, and strap means secured to said first and second upstanding end panels near the bottom of said end panels, one end of said strap means being connected to said first upstanding end panel and the other end of said strap means being connected to said second upstanding end panel, said assembled and operable seat capable of being easily and quickly converted into a tightly secured compact bundle or package for carrying, for use as a seat cushion or for storage, by adopting a procedure such as the following, place the seat in the assembled and operable position with said top panel facing upwardly, release the flaps on the top and bottom panels from the outside surfaces of the first and second upstanding end panels, respectively, by separating said two-part fasteners, rotate said top panel counterclockwise around said fold line interconnecting said top panel and said second upstanding end panel until said top panel at said fold line extends substantially normal to said second upstanding end panel and rotate said bottom panel clockwise around said fold line interconnecting said bottom panel and said first upstanding end panel until said bottom panel at said fold line extends substantially normal to said first upstanding end panel, further rotate or move said top panel clockwise until the outside surface of said top panel engages the outside surface of said second upstanding end panel, further rotate or move said bottom panel counterclockwise until the outside surface of said bottom panel engages the outside surface of said first upstanding end panel, compress said top and bottom panels, said end panels and said load supporting panels into a tight package of panels with said panels in said first and second plurality of load supporting panels being tightly folded together, move or rotate the flap on the bottom panel around the two fold lines therein until the part of the two-part fastener on the original outside surface of the flap and the part of the two-part fastener on the original inside surface of said top panel engage and hold all of the panels at one end of the package in tight engagement or assembly, said flap rotation about said second fold line and said two-part fastener holding said panels at one end of said package in tight engagement and assembly, rotate the package thus far assembled 180 degrees around the longitudinal axis thereof so that the original inside surface of the bottom panel is facing upwardly, pull the carrying strap from the inside of the package with loop portion of the strap positioned outside of the flap on the end of the top panel, compress said top and bottom panels, said end panels and said load supporting panels into a tight package with said panels in said first and second plurality of load supporting panels being tightly folded together, and move or rotate the flap on the top panel around the two fold lines therein until the part of the two-part fastener on the original outside surface of the flap and the part of the two-part fastener on the original inside surface of said bottom panel engage and hold all of the panels at the opposite end of the package in tight engagement and assembly, said flap rotation about said second fold line compressing said panels in said package and said two-part fastener holding said panels in said package in tight engagement and assembly, said strap means enabling said tightly secured compact bundle or package to be carried by hand or by placing the strap on the shoulder of one carrying or transporting said bundle or package, said strap also capable of being used to suspend said tightly secured compact bundle or package from a hanger or the like for storage.

22. A lightweight, waterproof and foldable seat capable of being easily and quickly converted from an assembled and operative seat or support into a tightly secured compact bundle or package for carrying, for use as a seat cushion or for storage as claimed in claim 21 wherein the procedure set forth in claim 21 for converting the seat or support into a tightly secured compact bundle or package is modified to include an alternate procedure comprising;

place the seat in the assembled and operable position with said bottom panel facing upwardly, release the flaps on the bottom and top panels from the outside surfaces of the second and first upstanding end panels, respectively, by separating said two-part fasteners, rotate said bottom panel counterclockwise around said fold line interconnecting said bottom panel and said first upstanding end panel until said bottom panel at said fold line extends substantially normal to said first upstanding end panel and rotate said top panel clockwise around said fold line interconnecting said top panel and said second upstanding end panel until said top panel at said fold line extends substantially normal to said second upstanding end panel, further rotate or move said bottom panel counterclockwise until the outside surface of said bottom panel engages the outside surface of said first upstanding end panel, further rotate or move said top panel clockwise until the outside surface of said top panel engages the outside surface of said second upstanding end panel, compress said bottom and top panels, said end panels and said load supporting panels into a tight package of panels with said panels in said first and second plurality of load supporting panels being tightly folded together, pull the carrying strap from the inside of the package with the loop portion of the strap positioned outside of the flap on the end of the top panel, move or rotate the flap on the top panel around the two fold lines therein until the part of the two-part fastener on the original outside surface of the flap and the part of the two-part fastener on the original inside surface of said bottom panel engage and hold all of the panels at one end of the package in tight engagement or assembly, said flap rotation about said second fold line and said two-part fastener holding said panels at one end of said package in tight engagement and assembly, rotate the package thus far assembled 180 degrees around the longitudinal axis thereof so that the original inside surface of the top panel is facing upwardly, compress said top and bottom panels, said end panels and said load supporting panels into a tight package with said panels in said first and second plurality of load supporting panels being tightly folded together, and move or rotate the flap on the bottom panel around the two fold lines therein until the part of the two-part fastener on the original outside surface of the flap and the part of the two-part fastener on the original inside surface of said top panel engage and hold all of the panels at the opposite end of the package in tight engagement and assembly, said flap rotation about said second fold line compressing said panels in said package and said two-part fastener holding said panels in said package in tight engagement and assembly, said strap means enabling said tightly secured compact bundle or package to be carried by hand or by placing the strap on the shoulder of one carrying or transporting said bundle or package, said strap also capable of being used to suspend said tightly secured compact bundle or package from a hanger for storage.

23. A lightweight, waterproof and foldable seat as claimed in claim 21 wherein said two-part fasteners take the form hook and loop fasteners with the hook part of the fasteners being rigidly secured to the outside and inside surfaces of said first and second upstanding end panels and with the loop part of said fasteners being rigidly secured to the inside and outside surfaces of the flaps connected to the top and bottom panels.

24. A lightweight, waterproof and foldable seat as claimed in claim 23 wherein said each of said two-part fasteners are rigidly secured to the inside and outside surfaces of said flaps and to the outside and inside surfaces of said first and second upstanding end panels by means of a rubber-based pressure sensitive adhesive.

25. A lightweight, waterproof and foldable seat as claimed in claim 21 wherein said strap means is comprised of a single strap having a preselected length and width and wherein said first and second upstanding end panels each have three spaced and parallel slots therein near the bottom of said panels in approximately the middle thereof, the ends of said straps being threaded into said three slots in each panel for tightly securing the ends of said strap to said upstanding end panels, said strap being secured in said slots from the inside of said end panels and extending along the inner surfaces of said end panels and through the area where said connector means are connected to said end panels and said upstanding load panels so as not to disconnect said connector means from said end panels and said load supporting panels when said strap is used to carry said tightly secured compact bundle or package.

* * * * *